US007595464B2

(12) United States Patent
Konishi

(10) Patent No.: US 7,595,464 B2
(45) Date of Patent: Sep. 29, 2009

(54) INFRARED RAY LAMP AND HEATING APPARATUS

(75) Inventor: Masanori Konishi, Osaka (JP)

(73) Assignee: Panasonic Corporation, Osaka (JP)

( * ) Notice: Subject to any disclaimer, the term of this patent is extended or adjusted under 35 U.S.C. 154(b) by 522 days.

(21) Appl. No.: 10/579,618

(22) PCT Filed: Nov. 12, 2004

(86) PCT No.: PCT/JP2004/016886

§ 371 (c)(1),
(2), (4) Date: May 17, 2006

(87) PCT Pub. No.: WO2005/051043

PCT Pub. Date: Jun. 2, 2005

(65) Prior Publication Data

US 2007/0110413 A1 May 17, 2007

(30) Foreign Application Priority Data

Nov. 20, 2003 (JP) ..... 2003-391214

(51) Int. Cl.
*H05B 3/00* (2006.01)
*F26B 3/30* (2006.01)

(52) U.S. Cl. ..... 219/216; 219/553; 219/541; 219/546; 219/548; 219/550; 392/407; 392/408; 392/422; 392/432; 392/424; 313/110; 313/113; 362/517

(58) Field of Classification Search ..... 219/553, 219/541, 546, 548, 550, 216; 392/407–8, 392/422, 432, 424; 313/110, 113; 362/517
See application file for complete search history.

(56) References Cited

FOREIGN PATENT DOCUMENTS

| | | | | |
|---|---|---|---|---|
| JP | 62-094732 | A | | 5/1987 |
| JP | 02-131106 | | | 10/1990 |
| JP | 3-124119 | | | 12/1991 |
| JP | 04-053103 | | | 5/1992 |
| JP | 04-324277 | A | | 11/1992 |
| JP | 07-230795 | A | | 8/1995 |
| JP | 07230795 | | * | 8/1995 |
| JP | 09-042684 | A | | 2/1997 |
| JP | 11-072234 | A | | 3/1999 |
| JP | 2000-346372 | A | | 12/2000 |
| JP | 2001-155692 | A | | 6/2001 |
| JP | 2001155692 | | * | 6/2001 |
| JP | 2001-219389 | | | 8/2001 |
| JP | 2001-319759 | A | | 11/2001 |
| JP | 2003-035422 | A | | 2/2003 |
| JP | 2003035422 | | * | 2/2003 |
| JP | 2003215964 | | | 7/2003 |

* cited by examiner

*Primary Examiner*—Shawntina Fuqua
(74) *Attorney, Agent, or Firm*—Harness, Dickey & Pierce, PLC

(57) ABSTRACT

The present invention provides an infrared ray lamp being small in size and high in efficiency and having high versatility so at to be easily adaptable to various applications, and also provides a heating apparatus that uses the infrared ray lamp; in the infrared ray lamp according to the present invention, plural heating elements made of a carbonaceous substance having high emissivity and large radiation energy are disposed accurately at desired positions and desired angles, and sealed inside a glass tube; a heating apparatus is configured by using this infrared ray lamp as a heat source.

26 Claims, 14 Drawing Sheets

INFRARED RAY LAMP AND HEATING APPARATUS

CROSS-REFERENCE TO RELATED APPLICATION

This application is based upon and claims the benefit of priority from Japanese Patent Application No. 2003-391214, filed on Nov. 20, 2003, the entire contents of which are incorporated herein by reference.

1. Technical Field

The present invention relates to an infrared ray lamp being used as a heat source and to a heating apparatus that uses the infrared ray lamp, such as electric heaters, cookers, driers and electronic apparatuses (including copying machines, facsimile machines and printers), and more particularly, to an infrared ray lamp that uses a carbonaceous substance as the material of heating elements and has excellent characteristics as a heat source and to a heating apparatus that uses the infrared ray lamp.

2. Background Art

In conventional infrared ray lamps, a metallic electric heating wire made of tungsten or the like and formed into a coil shape or a heating element made of a carbonaceous substance and formed into a bar shape or a plate shape is disposed inside a glass tube (for example, refer to Japanese Patent Application Laid-Open No. JP-A-2001-155692).

The conventional infrared ray lamps configured as described above are used as the heat sources of heating apparatuses, such as electric heaters, cookers, driers, copying machines, facsimile machines and printers, and in recent years they are used for various applications as compact and efficient heat sources (for example, Japanese Patent Application Laid-Open No. JP-A-2003-35423).

Patent document 1: Japanese Patent Application Laid-Open No. JP-A-2001-155692 (pages 4 to 6, FIG. 7)

Patent document 2: Japanese Patent Application Laid-Open No. JP-A-2003-35423 (page 2, FIG. 1).

DISCLOSURE OF THE INVENTION

Problem to be Solved by the Invention

An infrared ray lamp serving as a heat source in a heating apparatus is required to be smaller in size and higher in efficiency and also required to be high in versatility so at to be easily adaptable to various applications. In this field, providing an infrared ray lamp capable of satisfying the above-mentioned requirements and a heating apparatus using the infrared ray lamp has been an objective to be achieved.

For the purpose of achieving the above-mentioned objective, the present invention is intended to provide an infrared ray lamp being small in size and high in efficiency and having high versatility so at to be easily adaptable to various applications, and to provide a heating apparatus using the infrared ray lamp.

Means for Solving Problem

An infrared ray lamp according to a first aspect of the present invention comprises:

plural heating elements each having a long shape with at least one flat face and generating heat by virtue of application of a voltage, heating element holding means that disposes the heating elements in parallel so as to have a desired space therebetween and so that the flat faces of the heating elements are oriented in the same direction, a glass tube in which the heating elements and the heating element holding means are sealed, and lead wire portions electrically connected to the heating elements and derived from the sealed portions of the glass tube. In the infrared ray lamp according to the first aspect, configured as described above, because the flat faces of the plural heating elements provided in parallel are disposed so as to be surely oriented in the same direction, the heat radiation from the heating elements has directivity, and an object to be heated can be heated efficiently by the primary radiation heat from the heating elements.

An infrared ray lamp according to a second aspect of the present invention comprises:

plural heating elements each having a long shape with at least one flat face and generating heat by virtue of application of a voltage, heating element holding means that disposes the heating elements in parallel so as to have a desired space therebetween and so that the flat faces of the heating elements have a predetermined angle with respect to a reference face, a glass tube in which the heating elements and the element holding means are sealed, and lead wire portions electrically connected to the heating elements and derived from the sealed portions of the glass tube. In the infrared ray lamp according to the second aspect, configured as described above, because the flat faces of the plural heating elements provided in parallel are disposed so as to have a predetermined angle with respect to a reference face, the heat radiation from the heating elements can be carried out efficiently while having high directivity in a desired direction.

An infrared ray lamp according to a third aspect of the present invention is characterized in that the cross-sectional shape of the heating elements in the infrared ray lamp according to the above-mentioned first or second aspect, cross-sectioned in a direction orthogonal to the longitudinal direction thereof, is a substantially polygonal shape, and that the flat faces having the largest area in the heating elements are disposed so as to be oriented in the same direction, whereby the heat radiation from the heating elements can be carried out while having high directivity.

An infrared ray lamp according to a fourth aspect of the present invention is characterized in that the end faces of the heating elements in the infrared ray lamp according to the above-mentioned first or second aspect, cross-sectioned in a direction orthogonal to the longitudinal direction thereof, is formed by a straight line and an arc line, and that the flat faces of the heating elements are disposed so as to be oriented in the same direction, whereby the heat radiation from the heating elements can be carried out while having high directivity.

An infrared ray lamp according to a fifth aspect of the present invention is characterized in that the heating element holding means in the infrared ray lamp according to the above-mentioned first or second aspect comprises holding blocks having thermal conductivity and a spacer having electric insulation, and that the flat faces of the heating elements are disposed so as to be oriented in the same direction by securing the heating elements into slits formed in the holding blocks and by fitting the holding blocks into cutouts formed in the spacer. With this configuration of the infrared ray lamp according to the fifth aspect, the heat radiation from the heating elements to an object to be heated can be carried out while having high directivity and the heating elements can be easily disposed at proper positions while having a desired space therebetween.

An infrared ray lamp according to a sixth aspect of the present invention is characterized in that the heating elements of the infrared ray lamp according to the above-mentioned first to fifth aspects are solid carbonaceous heating elements inclining a carbonaceous substance and a resistance adjustment substance, and formed by firing. In the infrared ray lamp according to the sixth aspect, configured as described above, the materials of the heating elements include a carbonaceous substance, and the carbonaceous heating elements are formed by firing, whereby the emissivity of the heating elements is higher than that of a metallic heating element by 80% or more. The heating elements made of this kind of material are formed to have flat faces and to provide high directivity; hence, primary radiation is surely applied to an object to be heated, and it is possible to configure an infrared ray lamp having high radiation efficiency.

An infrared ray lamp according to a seventh aspect of the present invention is characterized in that the heating elements of the infrared ray lamp according to the above-mentioned first to fifth aspects include a carbonaceous substance and a resistance adjustment substance, and are solid carbonaceous heating elements formed by firing. In the infrared ray lamp according to the seventh aspect, configured as described above, the materials of the heating elements include a carbonaceous substance and a resistance adjustment substance, and the heating elements are formed by firing, whereby the emissivity of the heating element is higher than that of a metallic one by 80% or more. Furthermore, the installation directions of the heating elements can have desired directions by using holding means having elasticity. Because the heating elements made of this kind of material are formed to have flat faces so as to have high directivity in desired directions, primary radiation is surely applied to an object to be heated, and it is possible to configure an infrared ray lamp having high radiation efficiency.

A heating apparatus according to an eighth aspect of the present invention comprises an infrared ray lamp having:

plural heating elements each having a long shape with at least one flat face and generating heat by virtue of application of a voltage, heating element holding means that disposes the heating elements in parallel so as to have a desired space therebetween and so that the flat faces of the heating elements are oriented in the same direction, a glass tube in which the heating elements and the heating element holding means are sealed, and lead wire portions electrically connected to the heating elements and derived from the sealed portion of the glass tube, and the heating apparatus further comprising:

a reflector disposed so as to be opposed to the flat faces of the heating elements. In the heating apparatus according to the eighth aspect, configured as described above, because the flat faces of the plural heating elements provided in parallel are disposed so as to be surely oriented in the same direction, the heat radiation from the heating elements has directivity, and the primary radiation heat from the heating elements can be efficiently applied to an object to be heated.

A heating apparatus according to a ninth aspect of the present invention is characterized in that the cross-sectional shape of the reflector of the heating apparatus according to the above-mentioned eighth aspect, cross-sectioned in the direction orthogonal to the longitudinal direction thereof, has a convex portion protruding at the central portion of the reflection face thereof in the direction opposed to the flat faces of the heating elements. Because the heating apparatus according to the ninth aspect, configured as described above, can be configured so that the heat rays from the heating elements are diffusely reflected by the convex portion of the reflector, the radiation heat generated from the heating elements can be radiated efficiently in a wide range from the reflection face having the convex portion.

A heating apparatus according to a tenth aspect of the present invention is characterized in that the convex portion formed on the reflection face of the heating apparatus according to the above-mentioned ninth aspect is configured so that the heat rays from the heating elements are not radiated to the heating elements. Because the heating apparatus according to the tenth aspect, configured as described above, can be configured so that the heat radiation from the heating elements is not applied to the heating elements using the convex portion of the reflector, the radiation heat generated from the heating elements can be radiated efficiently in a wide range from the reflection face having the convex portion. In the heating apparatus according to the present invention, because the reflector has a shape so that the radiation heat generated from the heating elements to the reflector is not radiated to the heating elements, the secondary heating to the heating elements due to the reflector is suppressed; as a result, abnormal temperature rise in the heating elements is prevented, and the stability of the heating elements can be attained.

For example, the rate of resistance change of the heating elements has a negative or positive characteristic in most cases. This represents that the resistance value changes depending on the temperature of the heating elements. Furthermore, in the case that the rating of the heating elements is set, the rating is set in a self heat radiation state at an applied voltage in most cases. In the case that the heating elements being set as described above is built in a heating apparatus, if the temperature of the heating elements rises owing to the shape of the reflector, the rated input is changed despite designer's intentions. For the purpose of avoiding this kind of problem, it is preferable that the heating elements should be configured so as not to be affected by the radiation from the reflector.

A heating apparatus according to an 11th aspect of the present invention is characterized in that the cross-sectional shape of the reflector of the heating apparatus according to the above-mentioned eighth aspect, cross-sectioned in the direction orthogonal to the longitudinal direction thereof, is a parabolic shape, and that the substantially central point of heating in a heating element group consisting of the plural heating elements is disposed at the position of the focal point of the parabola. Because the substantially central point of heating in the heating element group of the heating apparatus according to the 11th aspect, configured as described above, is disposed at the position of the focal point of the parabola, the heat rays radiated from the heating element group and reflected by the reflector are radiated in parallel in the front direction of the apparatus, whereby parallel radiation is possible in a wide range. Moreover, in the heating apparatus configured as described above, the radiation heat reflected by the reflector further heats the heating elements; hence, the temperature of the heating elements can be raised higher, and high energy is radiated in the same direction from the flat faces of the heating elements, and the object to be heated can be heated to high temperature.

A heating apparatus according to a 12th aspect of the present invention is characterized in that the cross-sectional shape of the reflector of the heating apparatus according to the above-mentioned eighth aspect, cross-sectioned in the direction orthogonal to the longitudinal direction thereof, is a combination shape of plural parabolas, and that the substantially central point of heating in each heating element is disposed at the position of the focal point of each parabola. In the heating apparatus according to the 12th aspect, configured as described above, because the substantially central point of heating in each heating element is disposed at the position of the focal point of each parabola, the heat rays radiated from the plural heating elements and reflected by the reflector are radiated in parallel in the front direction of the apparatus, and parallel radiation is made possible in a wide range.

A heating apparatus according to a 13th aspect of the present invention is characterized in that the cross-sectional shape of the reflector of the heating apparatus according to the above-mentioned eighth aspect, cross-sectioned in the direction orthogonal to the longitudinal direction thereof, has a convex face protruding in a direction being opposed to the flat faces of the heating elements at the central portion of the reflection face thereof, and is configured so that the heat rays from the heating elements are diffusely reflected by the convex face. Because the heating apparatus according to the 13th aspect, configured as described above, is configured so that the heat rays from the heating elements are diffusely reflected by the convex face of the reflector, the radiation heat generated from the heating elements can be radiated efficiently from the reflection face in a wide range.

A heating apparatus according to a 14th aspect of the present invention is characterized in that the cross-sectional shape of the reflector of the heating apparatus according to the above-mentioned eighth aspect, cross-sectioned in the direction orthogonal to the longitudinal direction thereof, has a concave-convex face positioned so as to be opposed to the flat faces of the heating elements at the central portion of the reflection face thereof, and so that the heat rays from the heating elements are diffusely reflected by the concave-convex face. Because the heating apparatus according to the 14th aspect, configured as described above, is configured so that the heat rays from the heating elements are diffusely reflected by the concave-convex face of the reflector, the radiation heat generated from the heating elements can be radiated efficiently from the reflection face in a wide range.

A heating apparatus according to a 15th aspect of the present invention comprises an infrared ray lamp having:

plural heating elements each having a long shape with at least one flat face and generating heat by virtue of application of a voltage, heating element holding means that disposes the above-mentioned heating elements in parallel so as to have a desired space therebetween and so that the flat faces of the heating elements are oriented in the same direction, a glass tube in which the heating elements and the heating element holding means are sealed, lead wire portions electrically connected to the heating elements and derived from the sealed portions of the glass tube, and the heating apparatus further comprising:

a reflection film formed on the glass tube at a position opposed to the flat faces of the heating elements. Because the heating apparatus according to the 15th aspect, configured as described above, is configured so that the heat rays from the heating elements are reflected by the reflection film provided on the glass tube, the radiation heat generated from the heating elements can be radiated efficiently. Moreover, because the heating apparatus configured as described above is provided with the reflection film on the glass tube, the radiation heat reflected by the reflection film further heats the heating elements; hence, the temperature of the heating elements can be raised higher, and high energy is radiated in the same direction from the flat faces of the heating elements, and the object to be heated can be heated to high temperature.

A heating apparatus according to a 16th aspect of the present invention comprises an infrared ray lamp having:

plural heating elements each having a long shape with at least one flat face and generating heat by virtue of application of a voltage, heating element holding means that disposes the heating elements in parallel so as to have a desired space therebetween and so that the flat faces of the heating elements are oriented in the same direction, a glass tube in which the heating elements and the heating element holding means are sealed, lead wire portions electrically connected to the heating elements and derived from the sealed portion of the glass tube, and the heating apparatus further comprising:

a cylinder having a cylindrical shape and disposed so at to cover the heating elements. Because the heating apparatus according to the 16th aspect, configured as described above, is provided with the cylinder that covers the heating elements, foreign matter generated from an object to be heated and the like, such as broth or seasoning agents, is shielded by the cylinder and does not make direct contact with the infrared ray lamp; hence, breakage and wire disconnection due to deterioration in the surface of the infrared ray lamp can be prevented, and it is possible to configure an apparatus having a long service life. Furthermore, when the cylinder is used as a toner fixation roller, it is possible to build an electronic apparatus that can efficiently heat the portion at which the toner fixation roller makes contact with paper.

A heating apparatus according to a 17th aspect of the present invention is characterized in that the heating apparatus according to the above-mentioned eighth to 16th aspects further comprises:

plural external terminals respectively connected to the plural heating elements, plural power source terminals connected to a power source, and a control circuit that selectively connects the external terminals to the power source terminals so that is the heating elements are connected in series or parallel or connected independently. In the heating apparatus according to the 17th aspect, configured as described above, by the selective connection of the external terminals provided separately in the plural heating elements of one infrared ray lamp, the plural heating elements can be set in a series, parallel or independent power application state, and the input power and the temperature of the heating elements can be changed easily at the same rating.

A heating apparatus according to an 18th aspect of the present invention is characterized in that the control circuit of the heating apparatus according to the above-mentioned 17th aspect is configured so that circuits for ON-OFF control, power application ratio control, phase control and zero-cross control are used independently or at least two of the circuits are used in combination. In the heating apparatus according to the 18th aspect, configured as described above, because the control circuit is configured so that circuits for ON-OFF control, power application ratio control, phase control and zero-cross control are used independently or at least two of the circuits are used in combination, the heating apparatus can carry out highly accurate temperature control. Furthermore, because the heating apparatus according to the present invention is equipped with the plural heating elements, highly accurate temperature control capable of carrying out stable heating at a desired temperature with little variation is made possible by controlling part of the heating elements while electric power is supplied to required heating elements.

A heating apparatus according to a 19th aspect of the present invention is characterized in that the heating elements of the heating apparatus according to the above-mentioned 16th aspect are carbonaceous heating elements including a carbonaceous substance and formed by firing. In the heating apparatus according to the 19th aspect, configured as described above, the materials of the heating elements include a carbonaceous substance, and the heating elements are formed by firing, whereby the emissivity of the heating elements is higher than that of a metallic heating element by 80% or more. The heating elements made of this kind of material are formed to have flat faces and to provide high directivity; hence, primary radiation is surely applied to an object to be heated, and it is possible to configure a heating apparatus having high radiation efficiency.

A heating apparatus according to a 20th aspect of the present invention is characterized in that the heating elements of the heating apparatus according to the above-mentioned eighth to 16th aspects are solid carbonaceous heating elements including a carbonaceous substance and a resistance adjustment substance, and formed by firing.

Effect of the Invention

In the heating apparatus according to the present invention, configured as described above, because the materials of the heating elements include a carbonaceous substance and a resistance adjustment substance, and the heating elements are formed by firing, the emissivity of the heating elements is higher than that of a metallic heating element by 80% or more. Furthermore, the installation directions of the heating elements can have desired directions using securing means having elasticity. Because the heating elements made of such materials are formed to have flat faces so as to have high directivity in a desired direction, primary radiation is surely applied to an object to be heated, and it is possible to configure a heating apparatus having high radiation efficiency.

EXPLANATIONS OF NUMERALS

Figure 1:
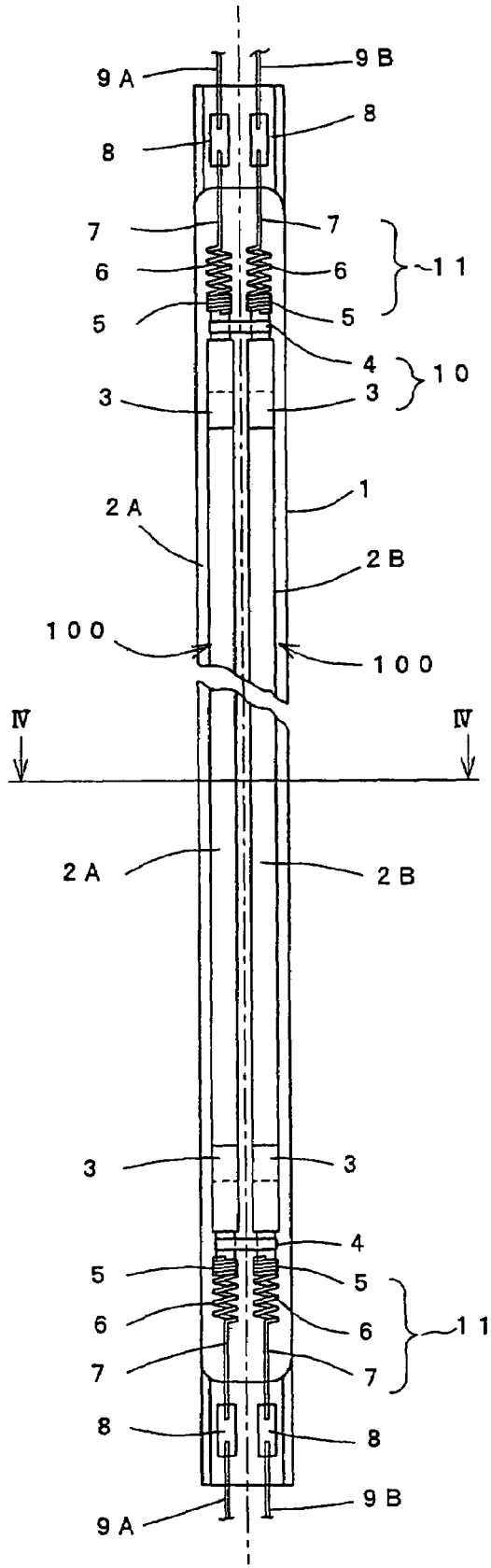
FIG. 1 is a front view showing the structure of an infrared ray lamp according to Embodiment 1 of the present invention.

1 glass tube
2A heating element
2B heating element
3 holding block
4 spacer
5 coil portion
6 spring portion
7 lead wire
8 molybdenum foil
9A external lead wire
9B external lead wire
10 heating element holder
11 internal lead wire portion
12 coil portion
13 spring portion
14 lead wire
15 molybdenum foil
16 external lead wire
30 holding block
40 internal lead wire portion
50 reflector
60 hot plate
70 reflection film
80 housing
90 infrared ray lamp
100 cylinder

BEST MODE FOR CARRYING OUT THE INVENTION

Embodiments specifically indicating the best modes for embodying the infrared ray lamp and the heating apparatus according to the present invention will be described below referring to the accompanying drawings. In the figure showing the whole of the infrared ray lamp according to each embodiment described below, because the infrared ray lamp is long, the intermediate portion thereof is cut away and not shown.

Embodiment 1

Figure 2:
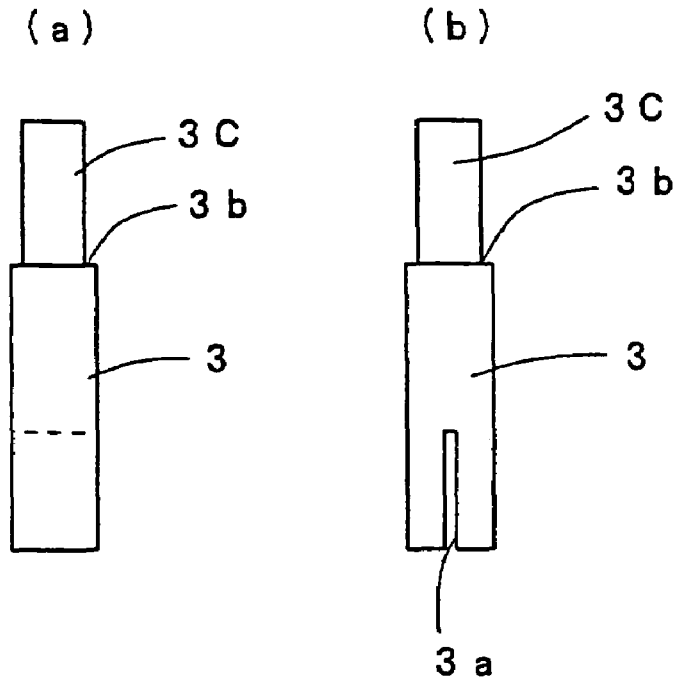
FIG. 2 is a view showing the shape of a heating element holder in the infrared ray lamp according to Embodiment 1 of the present invention.
Figure 3:
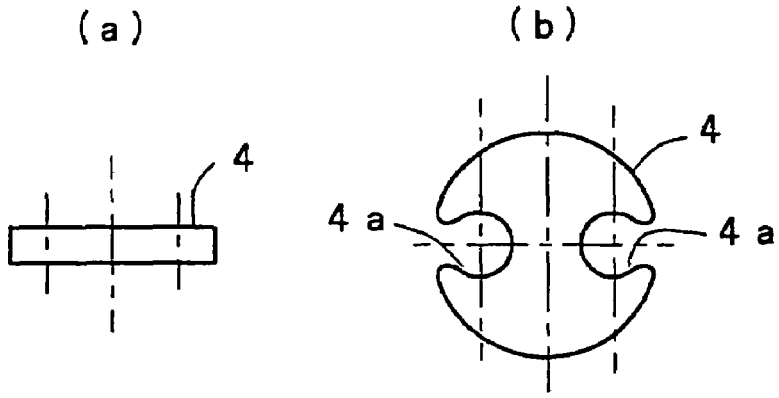
FIG. 3 is a view showing the shape of the heating element holder in the infrared ray lamp according to Embodiment 1 of the present invention.
Figure 4:
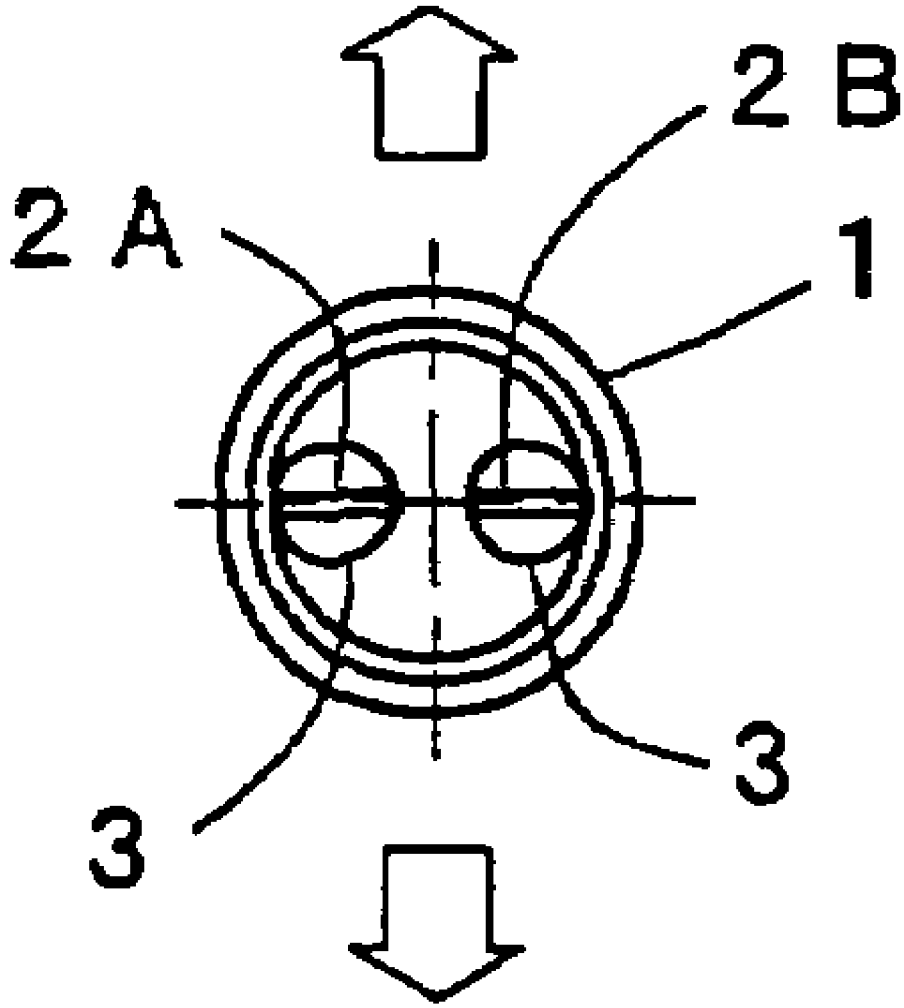
FIG. 4 is a sectional view of the infrared ray lamp, taken on line IV-IV of FIG. 1.
Figure 5:
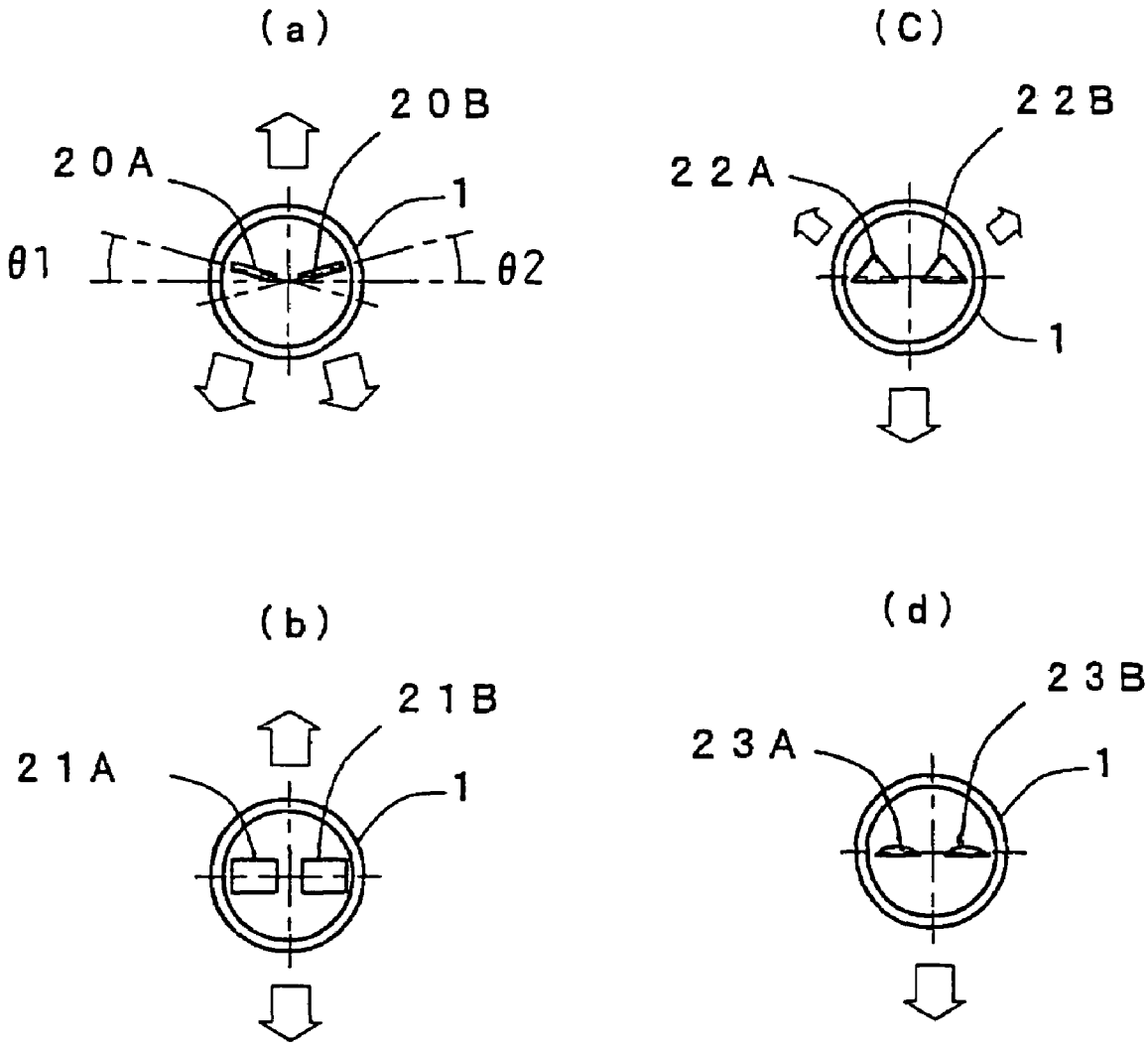
FIG. 5 is a sectional view showing a modification example of the heating element in the infrared ray lamp according to Embodiment 1 of the present invention.

FIGS. 1 to 3 are views showing an infrared ray lamp according to Embodiment 1 of the present invention. FIG. 1 is a front view showing the structure of the infrared ray lamp according to Embodiment 1. FIGS. 2 and 3 are views showing the shape of a heating element holder serving as heating element holding means in the infrared ray lamp according to Embodiment 1. FIG. 4 is a sectional view taken on line IV-IV of FIG. 1. FIG. 5 is a sectional view showing modification examples of the heating element in the infrared ray lamp according to Embodiment 1 of the present invention.

In the infrared ray lamp according to Embodiment 1, two heating structures 100 and 100 are disposed in parallel inside a glass tube 1 formed of a quartz glass tube, and the both ends of the glass tube 1 are melted, flattened and sealed. The interior of the glass tube 1 is filled with an inert gas, such as argon, or a mixed gas of argon and nitrogen. Each heating structure 100 comprises a heating element 2A or 2B having a long flat plate shape and serving as a heat radiator, holding blocks 3 secured to both ends of this heating element 2A or 2B, internal lead wire portions 11 connected to the ends of the holding blocks 3, and molybdenum foils 8 that electrically connect the internal lead wire portions 11 to external lead wires 9A and 9B. The portions in which the molybdenum foils 8 are disposed are the sealed portions of the glass tube 1.

For the purpose of disposing the two heating structures 100 and 100 in parallel so at to have a desired space therebetween, spacers 4 are provided for mutually securing the holding blocks 3 and 3 of the heating structures 100 and 100. In the infrared ray lamp according to Embodiment 1, the holding block 3 and the spacer 4 constitute a heating element holder 10.

As shown in FIG. 1, the internal lead wire portion 11 is connected to the end of the heating element holder 10, the end being opposite to the end at the holding block 3 secured to the heating element 2A or 2B. The internal lead wire portion 11 comprises a coil portion 5 wound tightly on the end of the holding block 3, a spring portion 6 and a lead wire 7 joined to the molybdenum foil 8. The coil portion 5, the spring portion 6 and the lead wire 7 in the internal lead wire portion 11 are formed of molybdenum wire in Embodiment 1. An example in which the internal lead wire portion 11 is formed of molybdenum wire is described in Embodiment 1; however, the internal lead wire portion 11 can be formed of metallic wire having elasticity, such as molybdenum wire and tungsten wire. The internal lead wire portion 11 is connected securely and electrically to the holding block 3 using the coil portion 5 wound spirally and tightly on the outer circumferential face of the end of the holding block 3. The spring portion 6 formed in a spiral shape and having an elastic force provides tension to the heating element 2A or 2B, and is configured so that the heating element 2A or 2B is disposed at a desired position at all times. In addition, the spring portion 6 provided between the lead wire 7 and the coil portion 5 can absorb a dimensional change owing to the expansion of the heating element 2A or 2B.

The lead wires 7 are joined near one ends of the molybdenum foils 8 by welding, and the external lead wires 9A and 9B that supply a power source voltage to the heating elements 2A and 2B are joined near the other ends of the molybdenum foils 8 by welding.

The two heating structures 100 and 100 configured as described above are disposed at desired positions inside the glass tube 1, and the glass tube 1 is flattened and sealed at the joint portions of the lead wires 7, the molybdenum foils 8 and the external lead wires 9A and 9B. The inert gas, such as argon, or the mixed gas of argon and nitrogen filled inside the glass tube 1 is used to prevent the oxidation of the heating elements 2A and 2B made of a carbonaceous substance.

FIG. 2 is a view showing the holding block 3 of the heating element holder 10 in the infrared ray lamp according to Embodiment 1; (a) is a front view thereof, and (b) is a side view thereof (a view seen from the right side of FIG. 1).

As shown in FIG. 2, at one end of the holding block 3 formed into a cylindrical shape, a slit 3*a* is formed so that each of the heating elements 2A and 2B is inserted therein and secured thereto. In addition, a step 3*b* is formed on the holding block 3, and the diameter of the other end of the holding block 3 is made smaller, whereby a small diameter portion 3*c* is formed. The holding block 3 is made of a material having high electrical conductivity and high thermal conductivity, such as a natural/artificial graphite material; the material is pulverized, molded, fired and then graphitized, and the graphite material of the holding block 3 is produced. Its shape is formed by cutting or other processing. Furthermore, the holding block 3 according to Embodiment 1 has a specific shape measuring 6.2 mm in diameter (the diameter of the small diameter portion 3*c* is 4.8 mm) and 18 mm in length.

The holding block 3 produced as described above is made of a material that is difficult to transfer heat from the heating element 2A or 2B to the coil portion 5 of the internal lead wire portion 11. In addition, the holding block 3 is bonded to the heating element 2A or 2B using a carbonaceous adhesive. The carbonaceous adhesive being used in Embodiment 1 is a paste-like adhesive made by mixing the fine powder of graphite or carbon in a thermoplastic or thermosetting resin.

In Embodiment 1, an example of bonding in which the holding block 3 is bonded to the heating element 2A or 2B using a carbonaceous adhesive is described; however, any well-known joining method can be used without causing problems, provided that the holding block 3 is joined securely and electrically to the heating element 2A or 2B.

FIG. 3 is a view showing the spacer 4 of the heating element holder 10; (a) is a front view thereof, and (b) is a plan view thereof (a view seen from above in FIG. 1).

As shown in FIG. 3, the spacer 4 has a disc shape, and cutouts 4*a* and 4*b* having a nearly circular shape are formed at the opposed positions on both sides thereof. The inside diameter of the cutouts 4*a* and 4*b* is formed to have a size so that the small diameter portion 3*c* of the holding block 3 described above can be fitted therein. When the holding blocks 3 and 3 to which the heating elements 2A and 2B are bonded are respectively fitted into the cutouts 4*a* and 4*b* of the spacer 4 in desired states (positions and angles), the heating elements 2A and 2B are disposed to have a desired space therebetween, and the flat face portions (the portions facing forward in FIG. 1) of the heating elements 2A and 2B can be disposed easily so as to be oriented in a desired direction. The specific shape of the spacer 4 being used for the infrared ray lamp according to Embodiment 1 is 17 mm in diameter and 1.5 to 2 mm in thickness, and the cutouts 4*a* and 4*b* are formed so that the diameter thereof is larger by 0.2 mm than the diameter of the small diameter portion 3*c* of the holding block 3. Furthermore, the cutouts 4*a* and 4*b* are formed so that the distance between the centers of the two holding blocks 3 and 3 is 9.2 mm.

In the heating structures 100 according to Embodiment 1, the holding block 3 to which the heating element 2A is secured and the holding block 3 to which the heating element 2B is secured as described above can be assembled easily and integrally in the assembly step of the infrared ray lamp so that they have the desired space therebetween and the flat face portions are oriented in the desired direction, whereby the step for inserting and sealing the heating structures into the glass tube is made easy. Hence, according to Embodiment 1, an infrared ray lamp having high heat radiation directivity in comparison with conventional infrared ray lamps can be produced easily.

The spacer 4 according to Embodiment 1 is made of a material having thermal resistance and insulation, such as alumina ceramic. In Embodiment 1, an example in which the spacer 4 is made of alumina ceramic is described; however, materials having thermal resistance, insulation and ease of machinability, such as steatite ceramics and machinable ceramics, can be used as the spacer 4.

In the infrared ray lamp according to Embodiment 1 configured as described above, when a desired voltage is applied to the external lead wires 9A and/or 9B respectively derived from both ends thereof, the desired voltage is applied from the internal lead wire portions 11, connected to the external lead wires 9A and/or 9B via the molybdenum foils 8 to the corresponding heating elements 2A and/or 2B, a current flows through the heating elements 2A and/or 2B, and heat is generated by virtue of the resistance of the heating elements 2A and/or 2B. Infrared rays are radiated from the heating elements 2A and/or 2B being heated at this time.

The heating elements 2A and 2B in the infrared ray lamp according to Embodiment 1 are made of a carbonaceous substance and formed into a long flat plate shape, and the carbonaceous substance is made of a mixture obtained by adding a nitrogen compound serving as a resistance value adjustment substance and amorphous carbon to a base material made of crystallized carbon, such as graphite.

In the infrared ray lamp according to Embodiment 1, the heating elements 2A and 2B serving as resistance heating elements and formed of a sintered body made of a carbonaceous substance were produced as described below.

First, 45 weight parts of chlorinated vinyl chloride resin and 15 weight parts of furan resin are mixed to form a first mixture. Next, 10 weight parts of fine powder of natural graphite (average grain size: 5 μm) and 60 weight parts of the first mixture are mixed to form a second mixture. Then, 30 weight parts of boron nitride (average grain size: 2 μm), 70 weight parts of the second mixture and 20 weight parts of diallyl phthalate monomer (plasticizing agent) are dispersed and mixed to form a third mixture. The third mixture formed as described above is molded into a plate shape by using an extrusion molding machine. The plate-shaped material formed as described above is fired in a firing furnace at 1000° C. for 30 minutes under nitrogen gas atmosphere. In addition, the material is heat-treated again in a vacuum of $1\times10^{-2}$ Pa or less so that the resistance temperature characteristic of the material has a desired characteristic. The heat treatment temperature at this time is set depending on the composition and shape of the material. The temperature is selected from the range of 1500° C. to 1900° C. in Embodiment 1. The change ratio of the electric specific resistance value [Ω·cm] of the heating element produced as described above is set in the range of −20% to +20% at 20° C. and 1200° C. It is preferable that the change ratio should be set in the range of −10% to +10%.

In the infrared ray lamp according to Embodiment 1, the heating elements 2A and 2B produced as described above have a plate width W of 6.0 mm, a plate thickness T of 0.5 mm and a length of 300 mm, for example. It is desirable that the ratio (W/T) of the plate width W and the plate thickness T in the heating elements 2A and 2B should be 5 or more. When the heating element is formed into a flat plate shape in which the plate width W is five or more times larger than the plate thickness T, the amount of heat radiated from the flat face (plate width W) is made larger than the amount of heat radiated from the narrow side face (plate thickness T) as a matter of course, and the heat radiation from the heating elements 2A and 2B having a flat plate shape can be provided with directivity.

FIG. 4 is a sectional view taken on line IV-IV of FIG. 1 and shows the arrangement of the glass tube 1 having a cylindrical shape and the two heating elements 2A and 2B having a flat plate shape. As shown in FIG. 4, in the infrared ray lamp according to Embodiment 1, the two heating elements 2A and 2B having a flat plate shape are provided accurately in parallel on the center line in the cross section of the glass-tube 1 having a nearly cylindrical shape, and disposed so that their flat face portions are oriented in the same direction. In other words, in FIG. 4, the two heating elements 2A and 2B having a flat plate shape are disposed so that their flat face portions are oriented in the up-down direction. For this reason, in the state shown in FIG. 4, the highest amount of heat is radiated in the up-down direction of the glass tube 1 of the infrared ray lamp; when an object to be heated is disposed thereabove or thereunder, the object to be heated is heated efficiently.

In the heating elements 2A and 2B made of a carbonaceous substance and used in Embodiment 1, heating efficiency is high, time required to reach the rated temperature from the start of heating is very short, and no rush current flows at the time of lighting up, whereby flicker that occurs during control can be reduced. Because the infrared ray lamp according to Embodiment 1 uses the heating elements 2A and 2B made of a carbonaceous substance, its service life is approximately 10,000 hours, that is, approximately twice the service life of a tungsten infrared ray lamp being used in similar service conditions, although the service life differs depending on the service conditions.

In addition, in the infrared ray lamp according to Embodiment 1, the two heating elements 2A and 2B made of a carbonaceous substance are provided in parallel. The resistance value of the heating element made of a carbonaceous substance differs depending on the shape and size thereof; as a result, the power consumed in the heating element also differs greatly. Hence, when an infrared ray lamp having a desired size is configured to have a desired power consumption amount, it is difficult to satisfy the need using one heating element, but it is easy to satisfy the need using two or more heating elements made of a carbonaceous substance. Furthermore, a desired amount of heat can be radiated stepwise by controlling the voltage applied to each heating element; still further, radiation heat can be adjusted stepwise by providing heating elements having different power consumption amounts in parallel.

In the infrared ray lamp according to Embodiment 1, the configuration in which the two heating elements 2A and 2B made of a carbonaceous substance are provided in parallel is described; however, the present invention is not limited to the configuration having two heating elements, but can be configured using three or more heating elements. Even in such a case, heating elements having a flat plate shape are provided in parallel on the center line in the cross section of the glass tube 1, and they are disposed so that their flat face portions are oriented in the same direction.

FIG. 5 is a sectional view showing a modification example of the heating element in the infrared ray lamp according to Embodiment 1 of the present invention. In FIG. 5, (a) to (d)

are sectional views in which the glass tube 1 of the infrared ray lamp is cross-sectioned in a direction orthogonal to the longitudinal direction (the extension direction) of the heating element in the glass tube 1, showing the sectional shapes and disposition states of the heating elements in the glass tube 1. The arrows shown in (a) to (d) of FIG. 5 indicate the main directions of radiation from the heating elements.

In the configuration shown in (a) of FIG. 5, a heating element 20A, one of the heating elements, is disposed on a line rotated clockwise by angle θ1 from the center line on which the heating elements 2A and 2B shown in FIG. 4 are disposed, while the center point in the cross section of the glass tube 1 is used as the center of the rotation. Furthermore, the other heating element 20B is disposed on a line rotated counterclockwise by angle θ2 from the center line on which the heating elements 2A and 2B shown in FIG. 4 are disposed, while the center point in the cross section of the glass tube 1 is used as the center of the rotation. The angle θ1 and the angle θ2 may be set at the same angle or may be set at different angles depending on the states of heating an object to be heated. For example, when an object to be heated is disposed in an arc shape around the infrared ray lamp, efficient radiation can be carried out by setting the angles of the heating elements 20A and 20B as described above and by disposing the heating elements 20A and 20B so that the respective flat face portions thereof are effectively oriented to the object to be heated (on the lower side of (a) of FIG. 5). On the other hand, when an object to be heated is intensively heated at the position opposed to the infrared ray lamp, efficient radiation can be carried out by disposing the heating elements 20A and 20B so that the flat face portions thereof are oriented to the object to be heated (on the upper side of (a) of FIG. 5).

In FIG. 5, (b) shows a configuration in which two heating elements 21A and 21B having a rectangular shape in cross section are provided in parallel, and desired amounts of heat can be radiated on the side faces (the left and right sides in (b) of FIG. 5) of the infrared ray lamp.

In FIG. 5, (c) shows a configuration in which two heating elements 22A and 22B having a triangular shape in cross section are provided in parallel, and desired amounts of heat can be radiated in three directions in the infrared ray lamp. In the configuration shown in (c) of FIG. 5, by the use of an isosceles triangle having one side being longer than the other two sides as the triangular sectional shape of the heating elements 22A and 22B, an object to be heated that is positioned opposed to the long side can be heated intensively.

In FIG. 5, (d) shows a configuration in which two heating elements 23A and 23B, with an end face having a shape formed by an arc line and a chord in cross section, that is, a shape in cross section similar to that of letter D, are provided in parallel, and an object to be heated that is disposed at a position opposed to the chords or the straight line portions of the cross sections of the heating elements 23A and 23B can be heated intensively.

As described above, in the infrared ray lamp according to Embodiment 1 of the present invention, plural heating elements serving as carbonaceous resistors having high emissivity and large radiation energy amounts are disposed at desired positions and desired angles, and sealed inside a glass tube, whereby radiation heat can be radiated efficiently from the heating elements to an object to be heated, and primary radiation to the object to be heated can be enhanced. Therefore, the infrared ray lamp according to Embodiment 1 can provide a highly efficient heating apparatus capable of quickly heating an object to be heated to a desired temperature.

Embodiment 2

Figure 6:
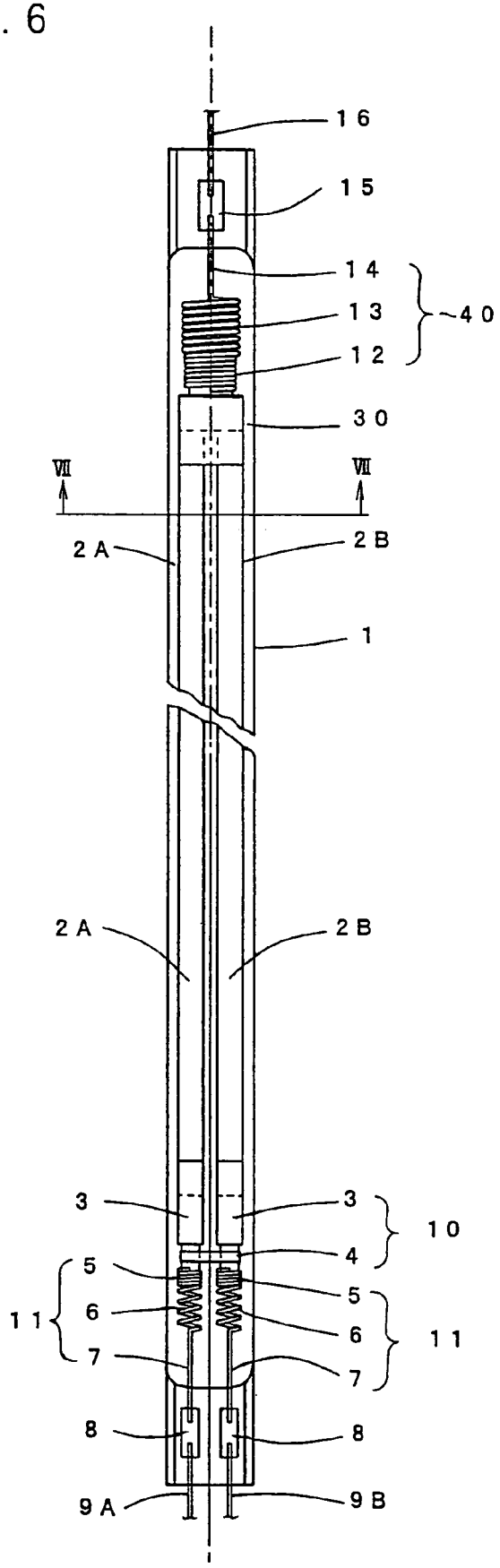
FIG. 6 is a front view showing the structure of an infrared ray lamp according to Embodiment 2 of the present invention.
Figure 7:
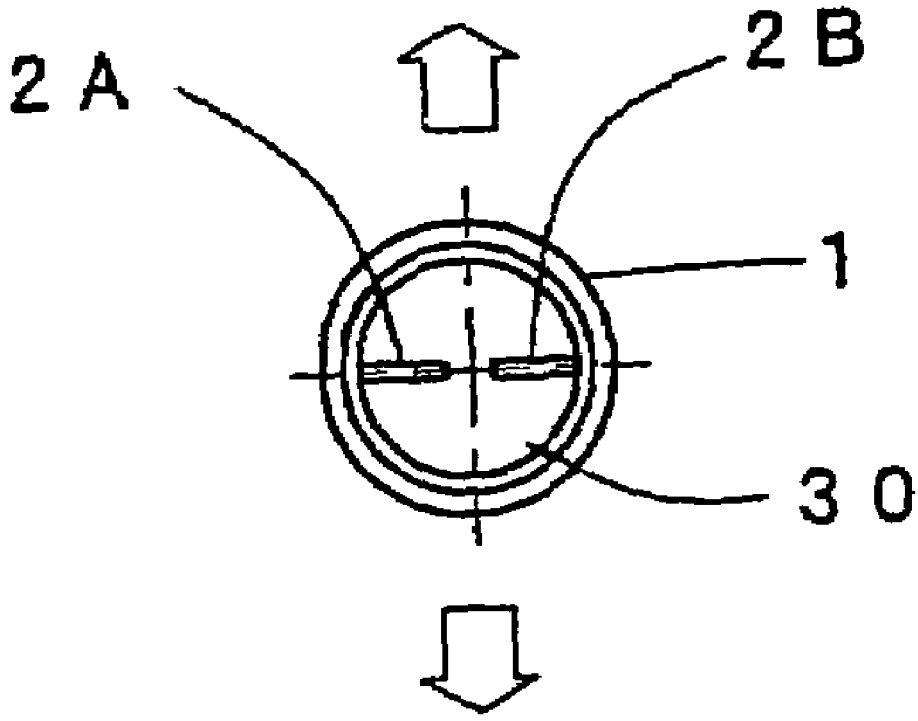
FIG. 7 is a sectional view of the infrared ray lamp, taken on line VII-VII of FIG. 6.

An infrared ray lamp according to Embodiment 2 of the present invention will be described below using the accompanying FIGS. 6 and 7. FIG. 6 is a front view showing the structure of the infrared ray lamp according to Embodiment 2. FIG. 7 is a sectional view of the infrared ray lamp, taken on line VII-VII of FIG. 6.

The infrared ray lamp according to Embodiment 2 differs from the infrared ray lamp according to Embodiment 1 described above in the configuration of the heating element holder that holds the two heating elements having a flat plate shape. As shown in FIG. 6, in the infrared ray lamp according to Embodiment 2, the one sides (the upper sides in FIG. 6) of the heating elements 2A and 2B are held in common. In the descriptions and figures in Embodiment 2, the components having the same functions and configurations as those used in Embodiment 1 are designated by the same numerals, and their descriptions are omitted. Furthermore, in Embodiment 2, the same components as those used in Embodiment 1 are made of the same materials.

In the infrared ray lamp according to Embodiment 2, the two heating elements 2A and 2B formed into a long flat plate shape are disposed inside the glass tube 1 formed of a quartz glass tube, and the holding blocks 3 are respectively secured to one ends (the lower ends in FIG. 6) of these heating elements 2A and 2B. The holding blocks 3 are held mutually using the spacer 4 while having a desired space therebetween, and the internal lead wire portions 11 are electrically connected to the ends of the holding blocks 3. The internal lead wire portions 11 are electrically connected to the external lead wires 9A and 9B through the molybdenum foils 8, and the portion in which the molybdenum foils 8 are disposed is the sealed portion at one end (the lower side) of the glass tube 1.

On the other hand, a holding block 30 that secures the two heating elements 2A and 2B so that a predetermined space is provided therebetween is provided at the other ends (the upper ends in FIG. 6) of the heating elements 2A and 2B disposed inside the glass tube 1. Slits are formed in the holding block 30 so that the two heating elements 2A and 2B are inserted therein and secured thereto, whereby the two heating elements 2A and 2B are held at a desired angle while having a desired space therebetween. An internal lead wire portion 40 is electrically connected to an end of the holding block 30. This internal lead wire portion 40 comprises a coil portion 12 wound tightly on the end of the holding block 30, a spring portion 13 and a lead wire 14 joined to a molybdenum foil 15. The internal lead wire portion 40 is electrically connected to an external lead wire 16 through the molybdenum foil 15, and the portion in which the molybdenum foil 15 is disposed is the sealed portion at the other end (the upper side) of the glass tube 1.

As shown in FIG. 7, in the infrared ray lamp according to Embodiment 2, the two heating elements 2A and 2B having a flat plate shape are provided accurately in parallel on the center line in the cross section of the glass tube 1, and disposed so that their flat face portions are oriented in the same direction. In other words, in FIG. 7, the two heating elements 2A and 2B, each having a flat plate shape, are disposed so that their flat face portions are oriented in the up-down direction. For this reason, in the state shown in FIG. 7, the highest amount of heat is radiated in the up-down direction of the glass tube 1 of the infrared ray lamp; when an object to be heated is disposed thereabove or thereunder, the object to be heated is heated efficiently.

As described above, the infrared ray lamp according to Embodiment 2 is configured so that either one ends of the heating elements are secured in common using the holding block and so that the heating elements are held while having a constant space therebetween. Hence, in the infrared ray lamp according to Embodiment 2, the spacer 4 should only be disposed only on one end sides of the heating elements; therefore, the configuration can be made simple, and the number of the connection points to the external lead wires can be reduced.

Embodiment 3

Figure 8:
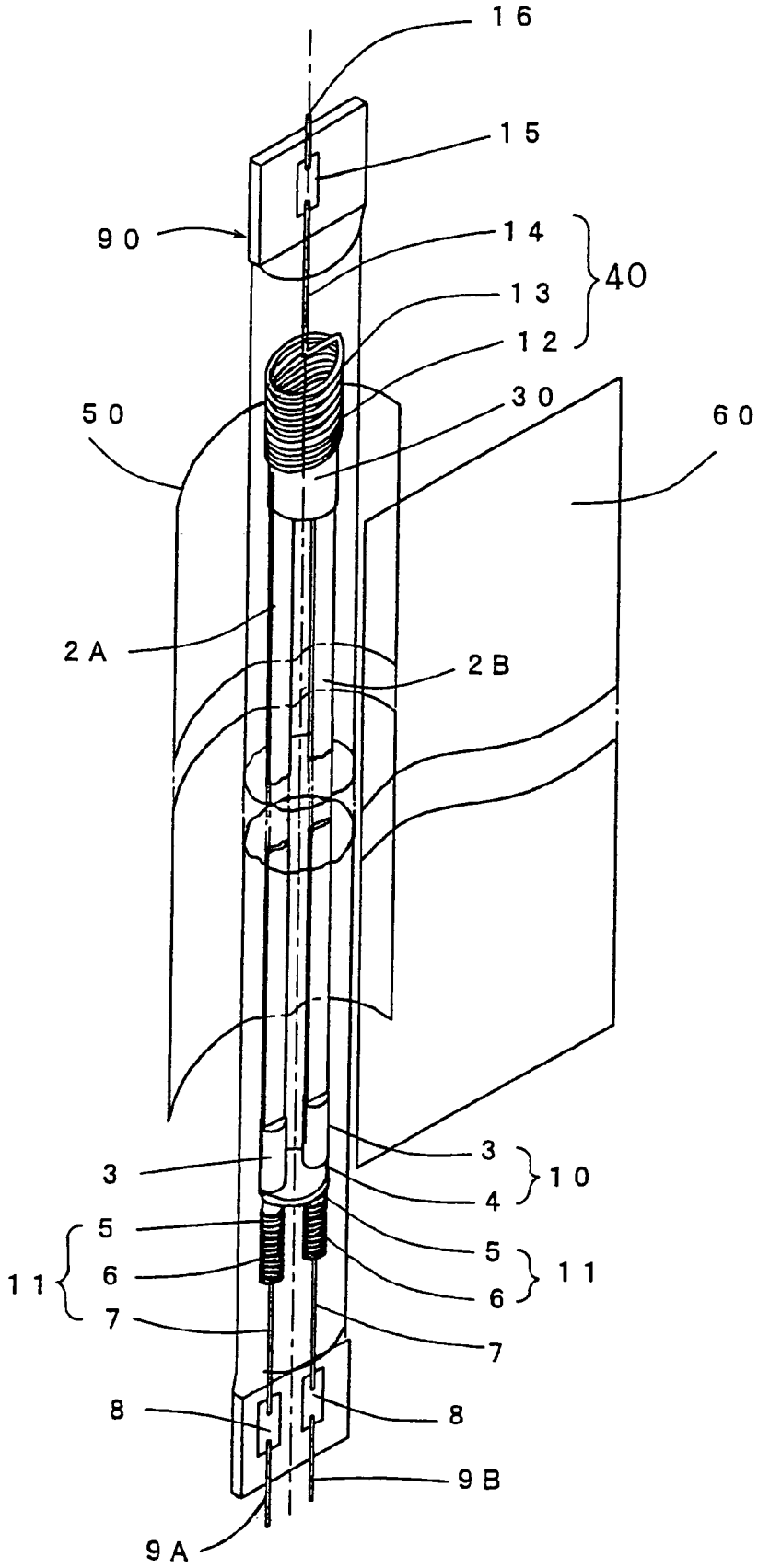
FIG. 8 is a perspective view showing the structure of an infrared ray lamp according to Embodiment 3 of the present invention.
Figure 9:
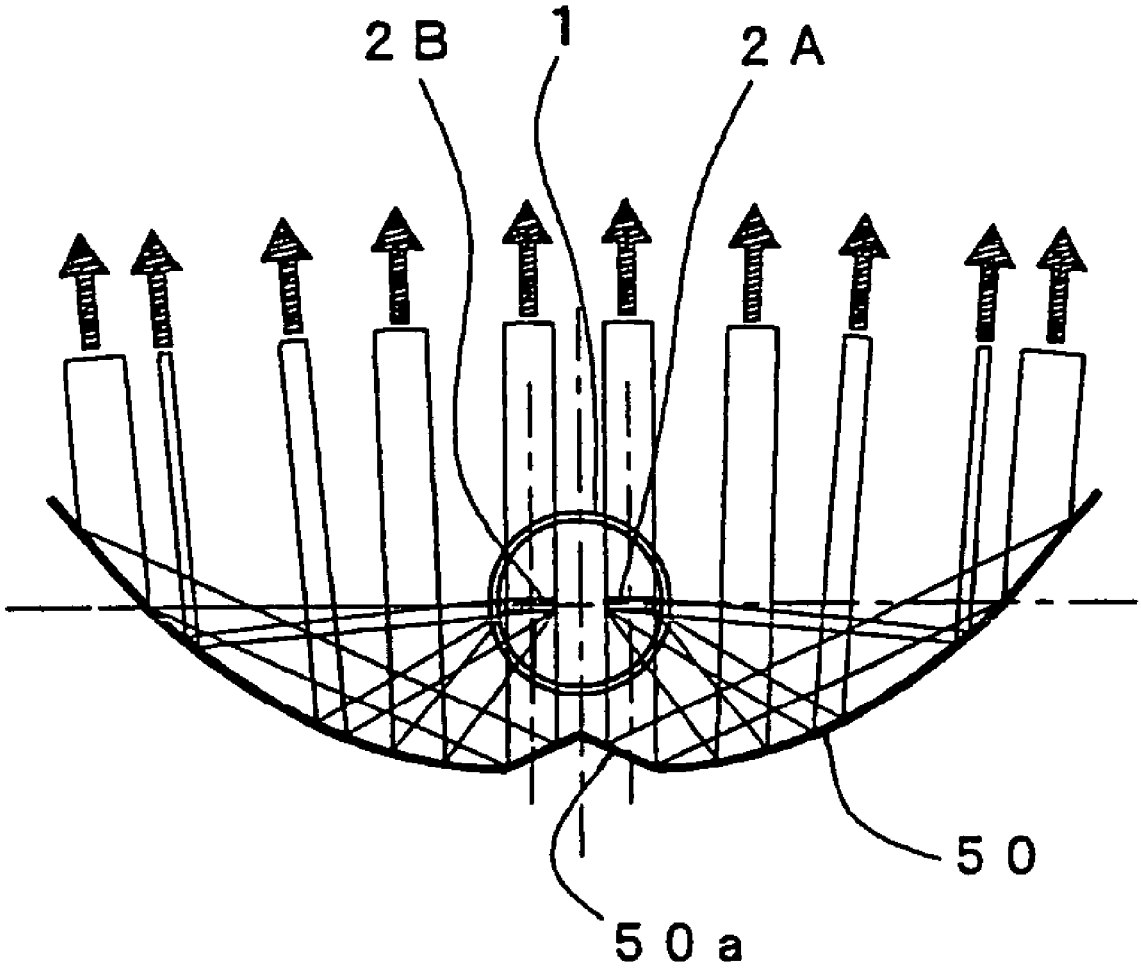
FIG. 9 is a sectional view showing the shape of a reflector being used in the heating apparatus according to Embodiment 3.

A heating apparatus according to Embodiment 3 of the present invention will be described below using the accompanying FIGS. 8 to 13. FIG. 8 is a perspective view showing the structure of the heat source of the heating apparatus according to Embodiment 3. FIG. 9 is a sectional view showing a reflector in the heating apparatus according to Embodiment 3. FIGS. 10 to 13 are sectional views showing modification examples of the reflector in the heating apparatus according to Embodiment 3.

The heating apparatus according to Embodiment 3 uses the infrared ray lamp according to Embodiment 2 described above as a heat radiation source. The heating apparatus according to Embodiment 3 is configured so that the reflector is provided behind the glass tube in the infrared ray lamp according to Embodiment 2 described above. As shown in FIG. 8, the infrared ray lamp in the heating apparatus according to Embodiment 3 is configured so that the one sides (the upper sides in FIG. 8) of the heating elements 2A and 2B are held in common, just like the infrared ray lamp according to Embodiment 2. In the descriptions and figures in Embodiment 3, the components having the same functions and configurations as those used in Embodiment 1 and Embodiment 2 are designated by the same numerals, and their descriptions are omitted. Furthermore, in Embodiment 3, the same components as those used in Embodiment 1 and Embodiment 2 are made of the same materials.

In the infrared ray lamp according to Embodiment 3, two heating elements 2A and 2B formed into a long flat plate shape are disposed inside the glass tube 1, and the flat face portions of the heating elements 2A and 2B are disposed so as to be oriented in the same direction. The holding blocks 3 are respectively secured to one ends (the lower ends in FIG. 8) of the heating elements 2A and 2B. The holding blocks 3 are held using the spacer 4 while having a desired space therebetween, and the internal lead wire portions 11 are electrically connected to the ends of the holding blocks 3. On the other hand, the holding block 30 that secures the two heating elements 2A and 2B so that a predetermined space is provided therebetween is provided at the other ends (the upper ends in FIG. 8) of the heating elements 2A and 2B. The two heating elements 2A and 2B are respectively inserted into and secured to the holding block 30, whereby the two heating elements 2A and 2B are held at desired positions while having a desired space therebetween. The internal lead wire portion 40 is electrically connected to an end of the holding block 30.

In the infrared ray lamp according to Embodiment 3, the two heating elements 2A and 2B each having a flat plate shape are provided accurately in parallel on the center line in the cross section of the glass tube 1, and disposed so that their respective flat face portions are oriented in the same direction. Hence, the heating apparatus according to Embodiment 3 is configured so that the highest amount of heat is radiated in the directions in which the flat face portions of the two heating elements 2A and 2B are oriented.

In the heating apparatus according to Embodiment 3, the infrared ray lamp configured as described above is provided as a heat radiation source; one of the two directions in which the flat face portions of the heating elements 2A and 2B of the infrared ray lamp are oriented is the front direction of the heating apparatus, and the other direction is the rear direction of the heating apparatus. In the perspective view of FIG. 8, the right front side with respect to the heating elements 2A and 2B corresponds to the front direction, and the left rear side with respect thereto corresponds to the rear direction.

As shown in FIG. 8, in the heating apparatus according to Embodiment 3, a reflector 50 is disposed in the rear direction of the heating elements 2A and 2B of the infrared ray lamp so as to be opposed to one of the flat face portions of each of the heating elements 2A and 2B. Furthermore, an object 60 to be heated is disposed in the front direction of the heating elements 2A and 2B of the infrared ray lamp so as to be opposed to the other flat face portion of each of the heating elements 2A and 2B.

FIG. 9 is a sectional view showing the shape of the reflector 50 being used in the heating apparatus according to Embodiment 3. A plate made of metal having high reflectivity, such as aluminum, aluminum alloy or stainless steel, or a plate obtained by forming a thin film of metal, such as aluminum, titanium nitride, nickel or chromium, on the surface of a heat-resistant material is used as the material of the reflector 50 in Embodiment 3.

The reflector 50 is formed so at to cover the rear sides of the heating elements 2A and 2B of the infrared ray lamp while having the same cross section along the extension direction (the up-down direction in FIG. 8) of the heating elements 2A and 2B. Furthermore, the reflector 50 is formed longer than the heating elements 2A and 2B in the extension direction (the longitudinal direction) of the heating elements 2A and 2B so at to cover at least the heating elements 2A and 2B.

As shown in FIG. 9, a convex portion 50*a* protruding in the front direction is formed at the central portion of the cross-sectional shape of the reflector 50 being cross-sectioned in the direction orthogonal to the extension direction (the longitudinal direction) thereof. The reflector 50 is disposed so that the vertex of this convex portion 50*a* is positioned at the intermediate point between the two heating elements 2A and 2B. Because the reflector 50 is formed as described above, heat rays radiated directly behind in the rear direction from the heating elements 2A and 2B are reflected by the inclined faces of the convex portion 50*a* of the reflector 50, radiated to the vicinities of the ends of the reflector 50 on the sides of the glass tube 1, and reflected in the front direction of the heating apparatus. Hence, the reflector 50 in the heating apparatus according to Embodiment 3 is configured so that the heat rays radiated directly behind the heating elements 2A and 2B are not reflected to the heating elements 2A and 2B but reflected to positions in which the heating elements 2A and 2B are not located.

As a result, in the heating apparatus according to Embodiment 3, together with the heat rays radiated from the front-side flat face portions of the heating elements 2A and 2B, the heat rays radiated from the rear-side flat face portions of the heating elements 2A and 2B are radiated in the front direction of the infrared ray lamp using the reflector 50, thereby efficiently heating an object to be heated that is disposed in the front direction of the heating apparatus.

Furthermore, the heating apparatus according to Embodiment 3 is configured so that the heat rays radiated from the rear-side flat face portions of the heating elements 2A and 2B are reflected in parallel in the front direction in the vicinities of the fringes of the reflector 50, whereby a hot plate 60 disposed so as to be opposed to the front sides of the heating elements 2A and 2B is heated in a wide range.

In the heating apparatus according to Embodiment 3 configured as described above, the heat radiation from the heating elements 2A and 2B is positively reflected in the front direction by the reflector 50, and the object 60 to be heated can be heated quickly and efficiently to a desired temperature.

In the description of Embodiment 3, the heating apparatus in which the flat face portions of the two heating elements are oriented in the same direction and disposed on the same straight line, that is, the heating elements are disposed so that their angles are 0°, is described; however, in the case that the two heating elements are disposed so as to have angles, a similar effect is obtained by changing the design of the shape of the reflector depending on the angles of the heating elements so that the heat radiation from the rear sides of the heating elements is reflected in the front direction. Furthermore, it is possible to increase the number of the heating elements to three or more depending on the specifications of the heating apparatus; even in that case, a similar effect is obtained by changing the design of the shape of the reflector depending on the locations of the heating elements.

FIGS. 10 to 13 are sectional views showing modification examples of the reflector in the heating apparatus according to Embodiment 3. FIGS. 10 to 13 are sectional views of the reflector cross-sectioned in the direction orthogonal to the extension direction (the longitudinal direction) of the heating elements. In these modification examples, the components having the same functions and configurations as those used in Embodiment 3 are made of the same materials and designated by the same numerals, and their descriptions are omitted.

Figure 10:
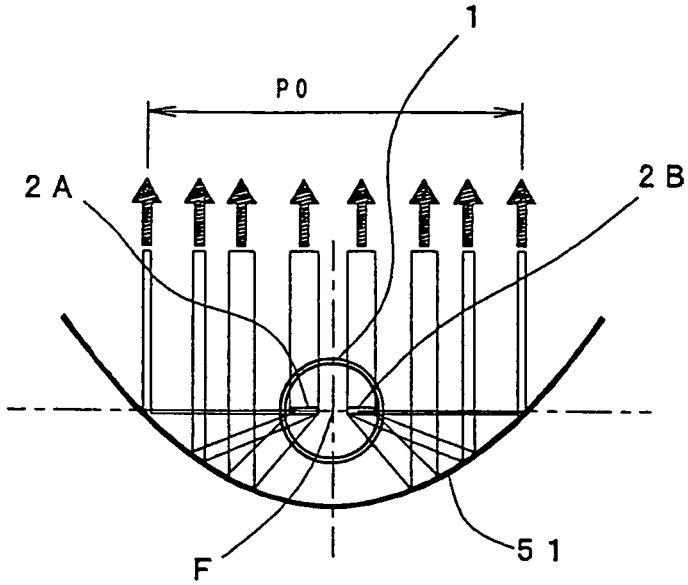
FIG. 10 is a sectional view showing another modification example of the reflector in the heating apparatus according to Embodiment 3.

The reflector 51 shown in FIG. 10 is configured so that the cross-sectional shape of the reflector 51 being cross-sectioned in the direction orthogonal to the extension direction thereof is a substantially parabolic shape and so that the position of the center point of the glass tube 1 is coincident with the position of the focal point F of the parabola. In other words, the focal point F of the parabolic shape of the reflector 51 is disposed at the intermediate position between the two heating elements 2A and 2B (the heating center position of the heating element group consisting of the two heating elements 2A and 2B). With this configuration, the heat rays radiated to the rear side of the glass tube 1 of the infrared ray lamp are radiated in parallel in the front direction of the infrared ray lamp. As a result, the object 60 to be heated that is disposed on the front side of the glass tube 1 is heated efficiently. At this time, part of the heat rays radiated directly behind from the rear sides of the heating elements 2A and 2B are reflected to the heating elements themselves; hence, the heating elements themselves are heated, and the temperature thereof becomes higher than that in the case that the reflector 50 shown in FIG. 9 is used. Hence, in the case that the reflector 51 shown in FIG. 10 is used, the heating apparatus has higher directivity and can carry out heating at higher temperature.

Figure 11:
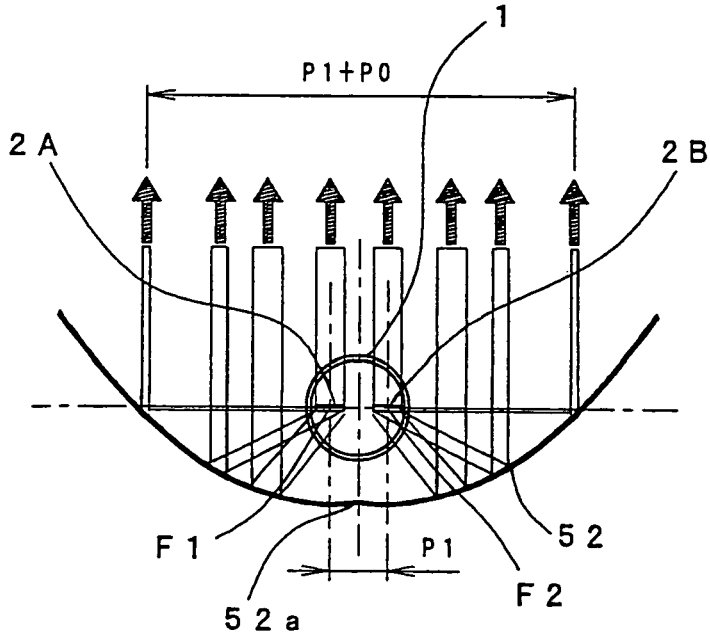
FIG. 11 is a sectional view showing still another modification example of the reflector in the heating apparatus according to Embodiment 3.

The reflector 52 shown in FIG. 11 is configured so that the cross-sectional shape of the reflector 52 being cross-sectioned in the direction orthogonal to the extension direction thereof is a combination of two substantially parabolic shapes, and so that the centers of the heating elements 2A and 2B are disposed at the positions of the focal points F1 and F2 of the parabolas. Hence, a convex portion 52*a* is formed at the central portion of the reflector 52. The vertex of this convex portion 52*a* is formed at the intermediate point between the two heating elements 2A and 2B. With this configuration, the heat rays radiated from the rear sides of the heating elements 2A and 2B of the infrared ray lamp are radiated in parallel in the front direction of the infrared ray lamp. As a result, the object 60 to be heated that is disposed on the front side of the glass tube 1 in which the heating elements 2A and-2B are sealed is heated efficiently. At this time, the heat rays radiated directly behind from the rear sides of the heating elements 2A and 2B are reflected to the heating elements themselves; hence, the heating elements themselves are heated, and the temperature thereof becomes higher than that in the case that the reflector 50 shown in FIG. 9 is used. Hence, in the case that the reflector 52 shown in FIG. 11 is used, the heating apparatus has higher directivity and can carry out heating at higher temperature.

In the configuration shown in FIG. 11, when it is assumed that the distance between the centers of the two heating elements 2A and 2B is P1 and that the length of the reflector 51 on the extension line of the position of the focal point F at which the front sides of the heating elements 2A and 2B are separated from the rear sides thereof in the configuration shown in FIG. 10 is P0, the length of the reflector 52 on the extension line of the positions of the focal points F1 and F2 at which the front sides of the heating elements 2A and 2B are separated from the rear sides thereof in the configuration shown in FIG. 11 is (P1+P0). In other words, the reflector 52 shown in FIG. 11 is configured so that radiation is carried out widely in parallel in the front direction in comparison with the radiation using the reflector 51 shown in FIG. 10.

Figure 12:
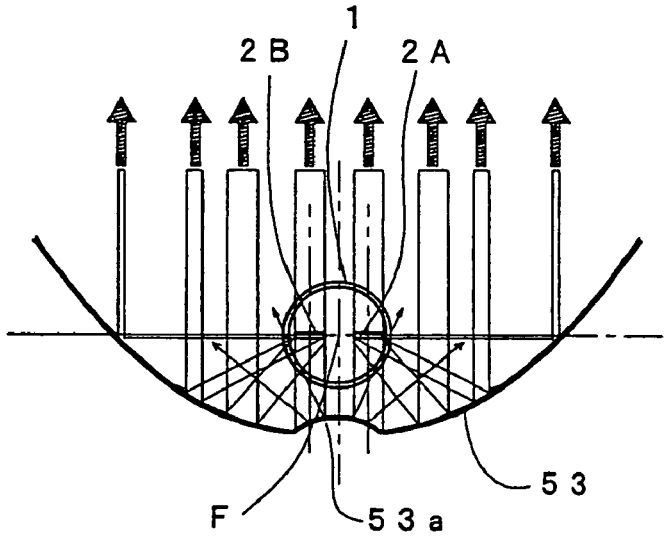
FIG. 12 is a sectional view showing yet still another modification example of the reflector in the heating apparatus according to Embodiment 3.

The reflector 53 shown in FIG. 12 is configured so that the cross-sectional shape of the reflector 53 being cross-sectioned in the direction orthogonal to the extension direction thereof is a substantially parabolic shape having a convex portion 53*a* protruding in the front direction at the central portion thereof and so that the position of the center point of the glass tube 1 is coincident with the position of the focal point F of the parabola. In other words, the focal point F of the parabolic shape of the reflector 53 is disposed at the intermediate position between the two heating elements 2A and 2B (the heating center position of the heating elements). With this configuration, most of the heat rays radiated to the rear side of the glass tube 1 of the infrared ray lamp are radiated in parallel in the front direction of the infrared ray lamp, and the heat rays radiated directly behind from the rear sides of the heating elements 2A and 2B are reflected by the convex portion 53*a* and scattered. As a result, the object 60 to be heated that is disposed on the front side of the glass tube 1 is heated efficiently in a wide range.

Figure 13:
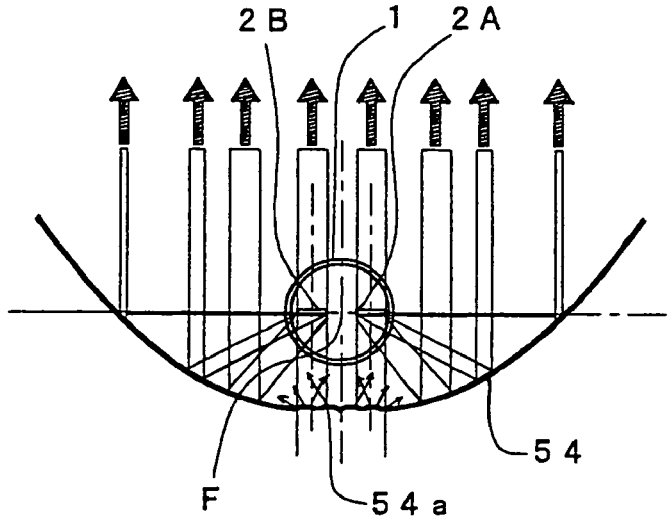
FIG. 13 is a sectional view showing a further modification example of the reflector in the heating apparatus according to Embodiment 3.

The reflector 54 shown in FIG. 13 is configured so that the cross-sectional shape of the reflector 54 being cross-sectioned in the direction orthogonal to the extension direction thereof is a substantially parabolic shape having a concave-convex portion 54*a* opposed to the flat face portions of the heating elements 2A and 2B at the central portion thereof and so that the position of the center point of the glass tube 1 is coincident with the position of the focal point F of the parabola. In other words, the focal point F of the parabolic shape of the reflector 54 is disposed at the intermediate position between the two heating elements 2A and 2B. With this configuration, most of the heat rays radiated to the rear side of the glass tube 1 of the infrared ray lamp are radiated in parallel in the front direction of the infrared ray lamp, and the heat rays radiated directly behind from the rear sides of the heating elements 2A and 2B are diffusely reflected by the concave-convex portion 54*a* and scattered. As a result, the object 60 to be heated that is disposed on the front side of the glass tube 1 is heated efficiently in a wide range.

As described above, in the configurations shown in FIGS. 12 and 13, the convex portion 53*a* or the concave-convex portion 54*a* is formed at the central portion (the portion opposed to the heating elements) of the reflector, whereby the heat rays diffusely reflected by the convex portion 53*a* or the concave-convex portion 54*a* are used as secondary radiation and can heat the object 60 to be heated in a wide range. As a result, by the use of the primary radiation having directivity and applied from the flat face portions of the heating elements 2A and 2B to the front sides and the secondary radiation including the diffused reflection generated by using the reflector 53 or 54, the surface of the object 60 to be heated can be heated efficiently in a wide range.

In the configurations shown in FIGS. 10 to 13, it is possible to increase the number of the heating elements to three or more depending on the specifications of the heating apparatus; even in that case, a similar effect is obtained by changing the design of the shape of the reflector depending on the locations of the heating elements.

Figure 14:
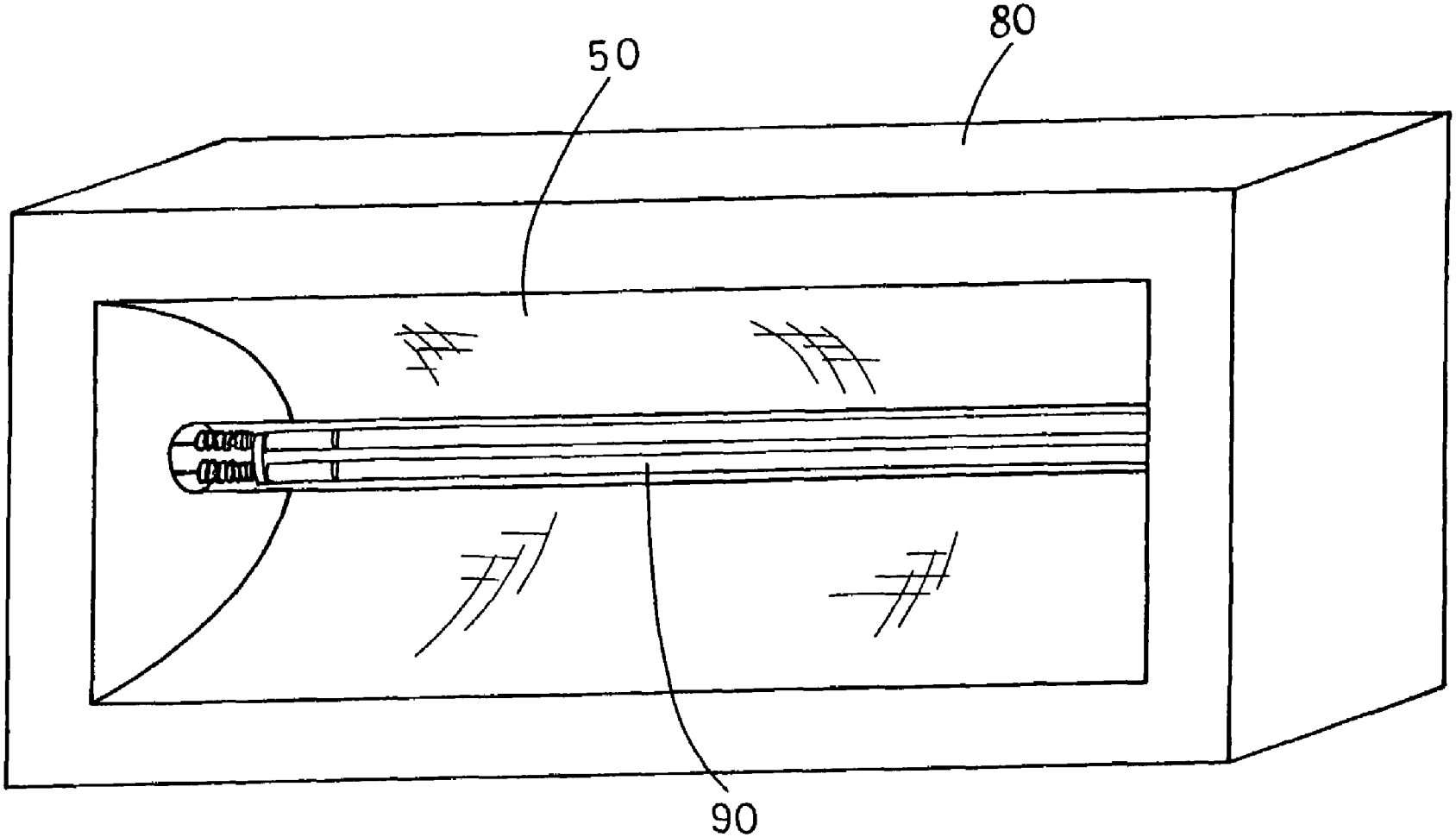
FIG. 14 is a perspective view showing an example of a heating apparatus that is configured so that the infrared ray lamp and the reflector according to Embodiment 3 are used as a heat source.

FIG. 14 is a perspective view showing an example of a heating apparatus that is configured so that the infrared ray lamp and the reflector configured as described above are used as a heat source. In the heating apparatus shown in FIG. 14, the reflector 50 and an infrared ray lamp 90 are disposed inside a housing 80. The reflector 50 and the infrared ray lamp 90 shown herein have the same configurations as those of the reflector 50 and the infrared ray lamp shown in FIG. 8 described above. Furthermore, as a heating apparatus, the infrared ray lamp and the reflector 51, 52, 53 or 54 shown in FIGS. 10 to 13 described above can also be provided as a heat source The heating apparatus in which the infrared ray lamp and the reflector are used as a heat source as described above can carry out wide-range heating, heating using parallel heat rays, uniform heating by virtue of desired diffused reflection and highly efficient heating, thereby being a heating apparatus having high versatility suited for objects to be heated and usage environment.

Herein, as examples of the heating apparatus, electric radiation heaters, such as heaters for room heating, cookers for cooking and heating, driers for foods and the like, electronic apparatuses for toner fixation and the like in copying machines, facsimile machines, printers, etc., and apparatuses required to carry out heating to high temperature in a short time are included.

Embodiment 4

Figure 15:
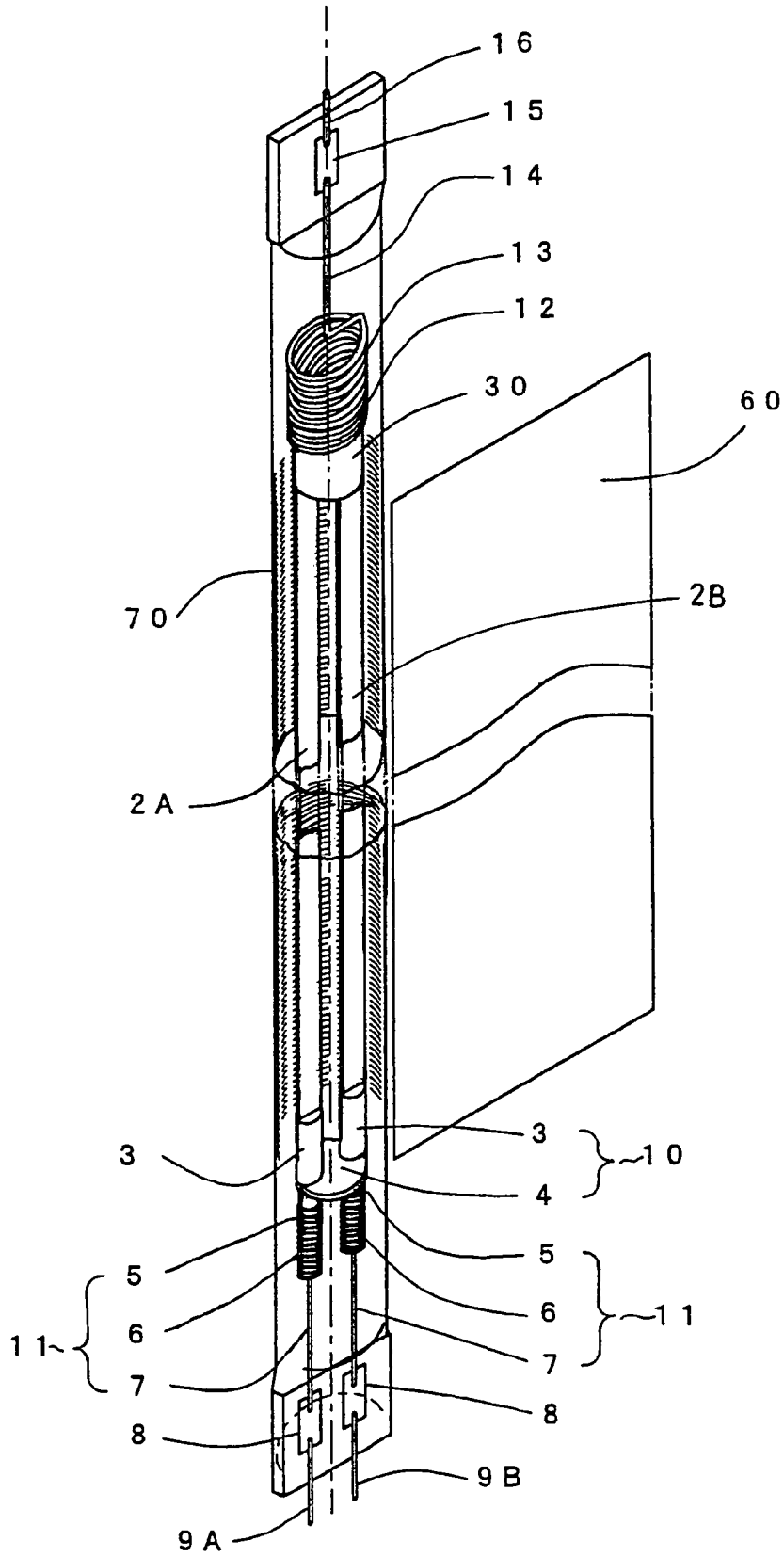
FIG. 15 is a perspective view showing the structure of the heat source of a heating apparatus according to Embodiment 4 of the present invention.

A heating apparatus according to Embodiment 4 of the present invention will be described below using the accompanying FIG. 15. FIG. 15 is a perspective view showing the structure of the heat source of the heating apparatus according to Embodiment 4.

The heating apparatus according to Embodiment 4 uses the infrared ray lamp according to Embodiment 2 described above as a heat radiation source. The heating apparatus according to Embodiment 4 is configured so that a reflection film is formed on the rear side of the glass tube in the infrared ray lamp according to Embodiment 2 described above. As shown in FIG. 15, the infrared ray lamp in the heating apparatus according to Embodiment 4 is configured so that the one sides (the upper sides in FIG. 15) of the heating elements 2A and 2B are held in common, just like the infrared ray lamp according to Embodiment 2. In the descriptions and figures in Embodiment 4, the components having the same functions and configurations as those used in Embodiment 1 to Embodiment 3 are designated by the same numerals, and their descriptions are omitted. Furthermore, in Embodiment 4, the same components as those used in Embodiment 1 to Embodiment 3 are made of the same materials.

In the infrared ray lamp according to Embodiment 4, two heating elements 2A and 2B formed into a long flat plate shape are disposed inside the glass tube 1 so that the flat face portions thereof are oriented in the same direction, and the holding blocks 3 are respectively secured to one ends (the lower ends in FIG. 15) of the heating elements 2A and 2B. The holding blocks 3 are held using the spacer 4 while having a desired space therebetween, and the internal lead wire portions 11 are electrically connected to the ends of the holding blocks 3. On the other hand, the holding block 30 that secures the two heating elements 2A and 2B so that a predetermined space is provided therebetween is provided at the other ends (the upper ends in FIG. 15) of the heating elements 2A and 2B. The two heating elements 2A and 2B are respectively inserted into and secured to the holding block 30, whereby the two heating elements 2A and 2B are held at desired positions while having a desired space therebetween. The internal lead wire portion 40 is electrically connected to an end of the holding block 30.

As shown in FIG. 15, a reflection film 70 is formed on the rear side of the glass tube 1 of the infrared ray lamp according to Embodiment 4. The heat rays radiated from the rear sides of the heating elements 2A and 2B are reflected by this reflection film 70 and radiated to the front side of the glass tube 1. A hot plate serving as the object 60 to be heated that is disposed on the front side of the glass tube 1 is heated by the heat rays radiated from the heating elements 2A and 2B.

The heating elements 2A and 2B are disposed at the central portion of the substantially cylindrical portion of the glass tube 1, and a center line is disposed at the intermediate position between the two heating elements 2A and 2B in the extension direction of the glass tube 1. The reflection film 70 formed on the rear side of the glass tube 1 is formed at the positions opposed to the side faces of the heating elements 2A and 2B, that is, formed into a semicircular shape in cross section. In Embodiment 4, an example in which the reflection film 70 is formed at the positions opposed to the side faces of the heating elements 2A and 2B is taken and described; however, the reflection film should only be formed at least at the positions opposed to the rear-side flat face portions of the heating elements 2A and 2B.

The reflection film 70 is made of a material having high reflectivity; in Embodiment 4, the reflection film was produced by transferring foil including gold to the outer wall of the glass tube 1 and then by carrying out firing.

In the infrared ray lamp in the heating apparatus according to Embodiment 4 configured as described above, the heat rays radiated from the rear sides of the heating elements 2A and 2B are positively reflected by the reflection film 70 formed on the glass tube 1 to the heating elements 2A and 2B and in the front direction; therefore, heating having high radiation intensity can be carried out for the object 60 to be heated that is disposed on the front side of the glass tube 1.

According to the experiments conducted by the inventors, when an identical voltage is applied to the heating elements 2A and 2B, the temperature of the heating elements was 1100° C. without the reflection film 70, and the temperature thereof was 1200° C. with the reflection film 70. Hence, the heating elements themselves can be high-energy radiators by providing the reflection film 70 on the glass tube 1.

In addition, because the heating apparatus according to Embodiment 4 is configured so that no reflector is provided around the glass tube 1 but the reflection film 70 is formed near the heating elements, the heat loss from the heating elements can be reduced in comparison with the configuration in which heat radiation is reflected by a reflector.

In Embodiment 4, an example in which the reflection film 70 was produced by transferring foil including gold to the outer wall of the glass tube 1 and by carrying out firing was taken and described; however, the present invention is not limited to this example; a similar effect can also be obtained even when the reflection film is produced using a material having high reflectivity, such as titanium nitride, aluminum, nickel, chromium or aluminum oxide.

In the heating apparatus configured so that the infrared ray lamp having the reflection film 70 configured as described above is used as a heat source, wide-range heating with high efficiency and heating with low heat loss can be made possible by disposing the infrared ray lamp having the reflection film 70 inside the housing as shown in FIG. 15 described above; therefore, it is possible to attain a heating apparatus having high versatility suited for objects to be heated and usage environment.

Herein, as examples of the heating apparatus, electric radiation heaters, such as heaters for room heating, cookers for cooking and heating, driers for foods and the like, electronic apparatuses for toner fixation and the like in copying machines, facsimile machines and printers, and apparatuses required to carry out heating to high temperature in a short time are included.

Embodiment 5

Figure 16:
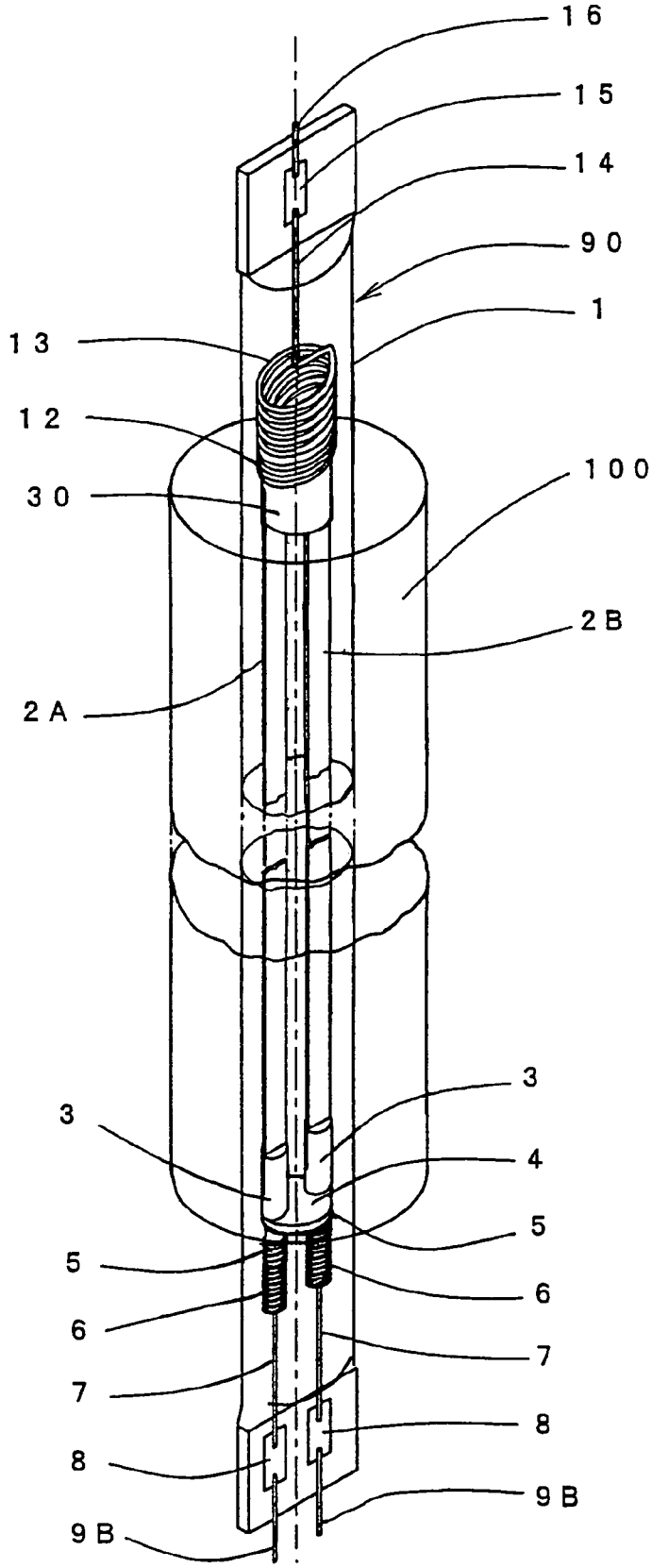
FIG. 16 is a perspective view showing the structure of the heat source of a heating apparatus according to Embodiment 5 of the present invention.

A heating apparatus according to Embodiment 5 of the present invention will be described below using the accompanying FIG. 16. FIG. 16 is a perspective view showing the structure of the heat source of the heating apparatus according to Embodiment 5.

The heating apparatus according to Embodiment 5 uses the infrared ray lamp according to Embodiment 2 described above as a heat radiation source. The heating apparatus according to Embodiment 5 is configured so that a cylinder is disposed around the glass tube in the infrared ray lamp according to Embodiment 2 described above. As shown in FIG. 16, the infrared ray lamp in the heating apparatus according to Embodiment 5 is configured so that the one sides (the upper sides in FIG. 16) of the heating elements 2A and 2B are held in common, just like the infrared ray lamp according to Embodiment 2. In the descriptions and figures in Embodiment 5, the components having the same functions and configurations as those used in Embodiment 1 to Embodiment 3 are designated by the same numerals, and their descriptions are omitted. Furthermore, in Embodiment 5, the same components as those used in Embodiment 1 to Embodiment 3 are made of the same materials.

As shown in FIG. 16, the heat source in the heating apparatus according to Embodiment 5 comprises an infrared ray lamp and a cylinder 100 having a cylindrical shape and disposed around the infrared ray lamp so as to cover it. The material of this cylinder 100 is selected depending on the purpose of use.

In the case of heating foods, the cylinder 100 is formed of a glass tube and is configured so that the heat radiation from the flat face portions of the heating elements 2A and 2B is transmitted therethrough. By the use of the cylinder 100 provided around the glass tube 1, even if seasoning agents, broth, etc. are dispersed during food heating, the dispersed matter does not make direct contact with the infrared ray lamp.

If high-temperature seasoning agents and broth make direct contact with the infrared ray lamp, the surface of the glass tube 1 is devitrified, and this causes a problem of breaking the glass tube 1. However, in the heating apparatus according to Embodiment 5 of the present invention, the above-mentioned problem is prevented completely, and the service life thereof can be extended.

In the case that the heating apparatus according to Embodiment 5 is used for toner fixation in electronic apparatuses, such as copying machines, facsimile machines and printers, the infrared ray lamp is disposed in the cylinder 100 which serves as a fixation roller. With this configuration of the electronic apparatus, the electronic apparatus can be configured so that the heat radiation having high directivity and generated from the flat face portions of the heating elements 2A and 2B inside the infrared ray lamp is applied to the fixation portion of the toner fixation apparatus, and it is possible to have a configuration in which the fixation portion is heated efficiently. By the use of the infrared ray lamp having high directivity as described above and being capable of carrying out quick heating to a desired temperature, the electronic apparatus can intensively heat the fixation face, and efficient operation can be carried out at the time of start, standby and the like of the apparatus.

By the use of the infrared ray lamp capable of carrying out heat radiation having high directivity and by the installation of the cylinder 100, having a different configuration depending on the purpose, around the infrared ray lamp as described above, the infrared ray lamp can be protected, and a heating apparatus being capable of carrying out quick heating and having high heating efficiency can be provided.

Herein, as examples of the heating apparatus, electric radiation heaters, such as heaters for room heating, cookers for cooking and heating, driers for foods and the like, and electronic apparatuses for toner fixation and the like are included.

Embodiment 6

Figure 17:
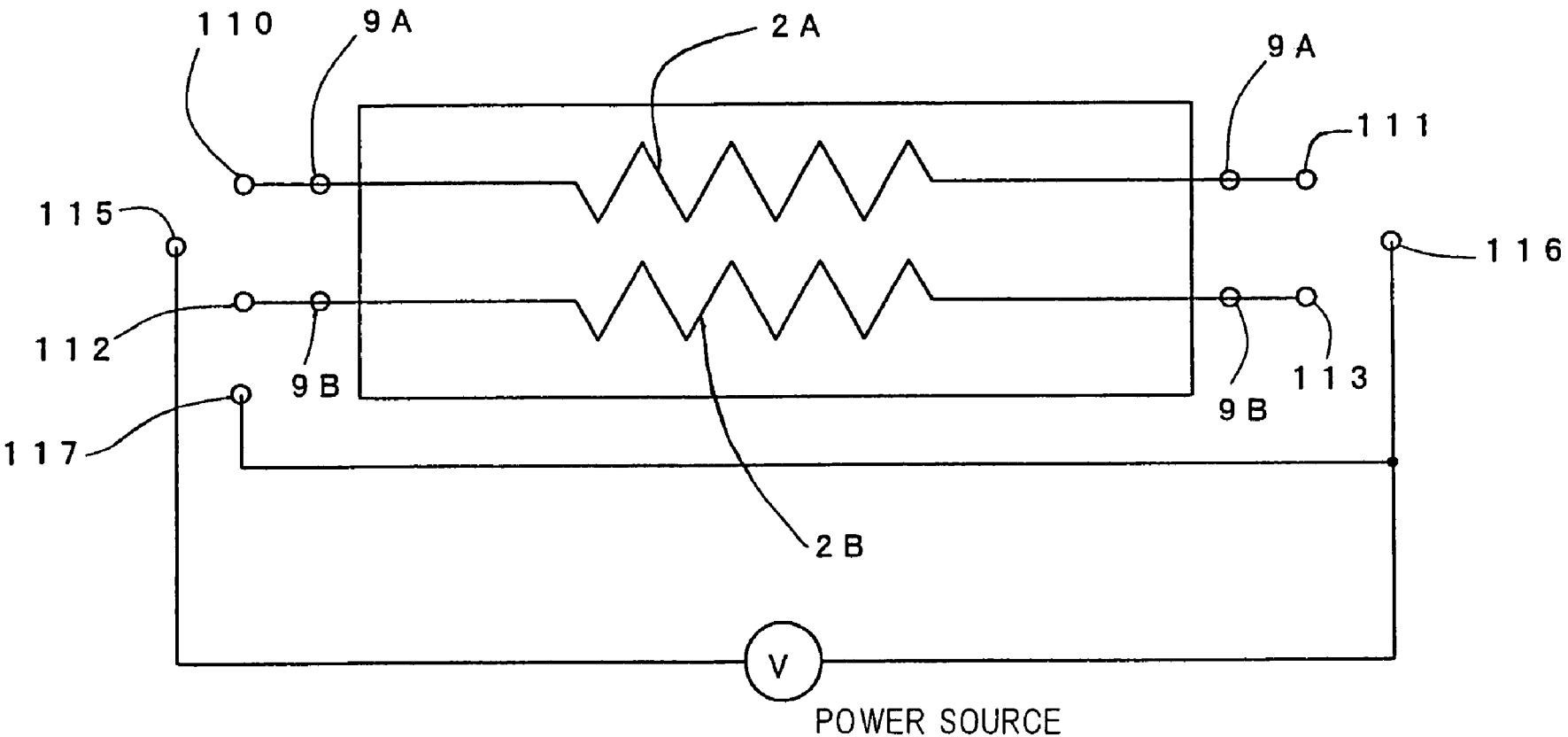
FIG. 17 is a circuit diagram showing a heating method being used in a heating apparatus according to Embodiment 6 of the present invention.

A heating apparatus according to Embodiment 6 of the present invention will be described below using the accompanying FIG. 17. FIG. 17 is a circuit diagram showing a heating method being used in the heating apparatus according to Embodiment 6.

The heating apparatus according to Embodiment 6 uses the infrared ray lamp according to Embodiment 1 described above as a heat radiation source, and is characterized in the method for controlling the heat radiation. The two heating elements 2A and 2B provided in the infrared ray lamp will be described below as a first heating element 2A and a second heating element 2B, respectively.

The circuit diagram shown in FIG. 17 is a diagram showing a method for controlling power application to the infrared ray lamp in the heating apparatus according to Embodiment 6, and shows a control circuit for the infrared ray lamp in the heating apparatus according to Embodiment 6. As shown in FIG. 17, a first external terminal 110 and a second external terminal 111 are provided for the external lead wires 9A connected to both ends of the first heating element 2A of the infrared ray lamp according to Embodiment 6. In addition, a third external terminal 112 and a fourth external terminal 113 are provided to the external lead wires 9B connected to both ends of the second heating element 2B of the infrared ray lamp according to Embodiment 6.

Furthermore, the control circuit in the heating apparatus according to Embodiment 6 is provided with three power source terminals 115, 116 and 117 connected to a power source V. The first power source terminal 115 is configured so that it can be connected simultaneously to both the first external terminal 110 and the third external terminal 112 or only to the first external terminal 110. The second power source terminal 116 is configured so that it can be connected simultaneously to both the second external terminal 111 and the fourth external terminal 113. Moreover, the third power source terminal 117 is configured so that it can be connected only to the third external terminal 112 when the first power source terminal 115 is connected only to the first external terminal 110. Still further, the second external terminal 111 of the first heating element 2A and the fourth external terminal 113 of the second heating element 2B are configured so as to be electrically connected to each other.

In the control circuit configured as described above, the power application control for the first heating element 2A and the second heating element 2B in the infrared ray lamp is carrying out as described below.

[Parallel Power Application Control]

In the case that power is applied to the first heating element 2A and the second heating element 2B in parallel, the first external terminal 110 of the first heating element 2A and the third external terminal 112 of the second heating element 2B are connected to the first power source terminal 115. At the same time, the second external terminal 111 of the first heating element 2A and the fourth external terminal 113 of the second heating element 2B are connected to the second power source terminal 116. With these connections in the control circuit, if both the first heating element 2A and the second heating element 2B have a power consumption of 500 W when 100 V is applied according to their specifications, for example, the power consumption of the infrared ray lamp is 1000 W when 100 V is applied from the power source V. Furthermore, if the first heating element 2A and the second heating element 2B have a heating element temperature of 1100° C. when 100 V is applied, both the first heating element 2A and the second heating element 2B respectively carry out heat radiation at a heating element temperature of 1100° C.

[Series Power Application Control]

In the case that power is applied to the first heating element 2A and the second heating element 2B in series, the first external terminal 110 of the first heating element 2A is connected to the first power source terminal 115. At the same time, the second external terminal 111 of the first heating element 2A and the fourth external terminal 113 of the second heating element 2B are electrically connected to each other. In addition, the third external terminal 112 of the second heating element 2B is connected to the third power source terminal 117. With these connections in the control circuit, in the case that the first heating element 2A and the second heating element 2B have the above-mentioned specifications, the power consumption of the infrared ray lamp is 500 W when 100 V is applied from the power source V. Furthermore, in the case that the first heating element 2A and the second heating element 2B that have a heating element temperature of 1100° C. when 100 V is applied are used, both the first heating element 2A and the second heating element 2B carry out heat radiation at a heating element temperature of approximately 700° C.

[Independent Power Application Control]

For example, in the case that power is applied only to the first heating element 2A independently, the first external terminal 110 of the first heating element 2A is connected to the first power source terminal 115. At the same time, the second external terminal 111 of the first heating element 2A is connected to the second power source terminal 116. At this time, no voltage is applied to the second heating element 2B. With these connections in the control circuit, in the case that the first heating element 2A has the above-mentioned specifications, the power consumption of the infrared ray lamp is 500 W when 100 V is applied from the power source V. In addition, the first heating element 2A carries out heat radiation at a heating element temperature of 1100° C.

By the provision of the three power source terminals as described above, heating adjustment is made possible by changing the temperature of the heating elements through power application circuit selection, even if an identical input is applied to the infrared ray lamp. Hence, in the heating apparatus according to Embodiment 6, the flat face portions of the heating elements are oriented in desired directions; furthermore, by carrying out power application control, the heat radiation has excellent directivity, whereby the heating temperature can be controlled easily so as to be adapted for an apparatus to be heated.

In the heating apparatus according to Embodiment 6, an example in which heat radiation is controlled using the infrared ray lamp according to Embodiment 1 is taken and described; however, the present invention is not limited to this kind of control method, but the heat radiation can also be controlled using the infrared ray lamps according to Embodiment 2 to Embodiment 5 described above as a heat radiation source. In the case of such a configuration, the second power source terminal 116 shown in FIG. 17 should only be made connectable to one external lead wire (designated by numeral 16 in FIG. 8) derived from one end of the infrared ray lamp.

In addition, in the heating apparatus according to Embodiment 6, temperature control can be added as a selection condition in the case of carrying out power application control. For temperature control, ON-OFF control in which a temperature detecting means, such as a thermostat, is used, input power source phase control in which a temperature sensor that accurately senses temperature is used, power application ratio control and zero-cross control are carried out independently or in combination, whereby it is possible to realize a heating apparatus capable of carrying out highly accurate temperature control. Hence, with the heating apparatus according to Embodiment 6 configured as described above, heating being excellent in radiation characteristics and highly accurate temperature control can be attained by the directivity control at the flat face portions of the heating elements and by the power application control.

As clarified by the descriptions of the respective embodiments described above, according to the present invention, the primary radiation from the heating elements to an object to be heated can be carried out efficiently by accurately disposing plural heating elements formed of a carbonaceous resistor having high emissivity and large radiation energy at desired positions and desired angles and by sealing them inside a glass tube. In addition, in the infrared ray lamp according to the present invention, the primary radiation from the heating elements to the object to be heated can be enhanced by forming a reflector or a reflection film having a desired shape, and the secondary radiation to the object to be heated can also be enhanced by efficiently reflecting the heat radiated from the heating elements in directions different from the direction of the object to be heated. Furthermore, the present invention can provide a highly efficient apparatus capable of quickly heating the object to be heated up to a desired temperature by providing the infrared ray lamp configured as described above as a heat source in the heating apparatus.

In the infrared ray lamp according to the present invention, because the flat faces of the plural heating elements provided in parallel are disposed so as to be surely oriented in the same direction, the heat radiation from the heating elements has directivity, and an object to be heated can be heated efficiently by the primary radiation heat from the heating elements.

In the infrared ray lamp according to the present invention, because the flat faces of the plural heating elements provided in parallel are disposed so as to have a predetermined angle with respect to a reference face, the heat radiation from the heating elements can be carried out efficiently while having high directivity in a desired direction.

In the heating apparatus according to the present invention, because the flat faces of the plural heating elements provided in parallel are disposed so as to be surely oriented in the same direction, the heat radiation from the heating elements has directivity, and the primary radiation heat from the heating elements can be applied efficiently to the object to be heated.

In the heating apparatus according to the present invention, part of the reflector is configured so that the heat radiation from the heating elements is not applied to the heating elements; hence, the secondary heating to the heating elements due to the reflector is suppressed, abnormal temperature rise in the heating elements is prevented, and the stability of the heating elements can be attained.

Because the substantially central point of the heating of the heating elements of the heating apparatus according to the present invention is disposed at the position of the focal point of the parabola, the heat rays radiated from the heating elements and reflected by the reflector are further radiated in parallel in the front direction of the apparatus, and an object to be heated can be heated efficiently by the wide-range parallel radiation.

The heating apparatus according to the present invention is configured so that the heat rays from the heating elements are reflected by the reflection film provided on the glass tube; hence, the radiation heat from the heating elements is radiated efficiently, and high energy is radiated in the same direction from the flat faces of the heating elements, whereby the object to be heated can be heated to high temperature.

Because the heating apparatus according to the present invention is provided with the cylinder that covers the heating elements, foreign matter generated from an object to be heated and the like, such as broth or seasoning agents, is shielded by the cylinder and does not make direct contact with the infrared ray lamp; hence, breakage and wire disconnection due to deterioration in the surface of the infrared ray lamp can be prevented, and the apparatus can have long service life. Furthermore, when the cylinder that covers the heating elements is used as a toner fixation roller, it is possible to build an electronic apparatus that can efficiently heat the portion at which the toner fixation roller makes contact with paper.

In the heating apparatus according to the present invention, by the selective connection of the external terminals provided separately in the plural heating elements of one infrared ray lamp, the plural heating elements can be set in a series, parallel or independent power application state, and the input power and the temperature of the heating elements can be changed easily at the same rating.

The control circuit of the heating apparatus according to the present invention is configured so that circuits for ON-OFF control, power application ratio control, phase control and zero-cross control are used independently or at least two of the circuits are used in combination; hence, the heating apparatus can carry out highly accurate temperature control.

Because the heating apparatus according to the present invention uses the carbonaceous heating elements made of a material including a carbonaceous substance and formed by firing, primary radiation is positively applied to an object to be heated, and it is possible to configure a heating apparatus having high radiation efficiency.

Although the present invention has been described with respect to its preferred embodiments in some detail, the disclosed contents of the preferred embodiments may change in the details of the structure thereof, and any changes in the combination and sequence of the components may be attained without departing from the scope and spirit of the claimed invention.

INDUSTRIAL APPLICABILITY

The heating apparatus that uses the infrared ray lamp according to the present invention as a heat source can be used as a heating unit for electric heaters (heaters for room heating and the like), electric cookers and electronic apparatuses, for example, has excellent heating functions, and is useful.

The invention claimed is:

1. An infrared ray lamp comprising:

two or more heating elements each having a long shape with at least one flat face and generating heat by virtue of application of a voltage, heating element holding means that disposes said heating elements in parallel so as to have a desired space therebetween and so that said flat faces of said heating elements have a predetermined angle with respect to a reference face, a glass tube in which said heating elements and said heating element holding means are sealed, and lead wire portions electrically connected to said heating elements and derived from the sealed portions of said glass tube, wherein said heating elements are carbonaceous heating elements including a carbonaceous substance and formed by firing, and said heating element holding means comprises;

holding blocks which are made of a material having thermal conductivity, and which have slits for inserting and fixing said heating elements, and a spacer which is made of an insulation material, and which has cutouts for holding said holding blocks to have a desired interval and a desired angle by fitting said holding block into said cutouts.

2. The infrared ray lamp according to claim 1, wherein the cross-sectional shape of said heating elements, cross-sectioned in a direction orthogonal to the longitudinal direction thereof, is a substantially polygonal shape, and said flat faces having the largest area in said heating elements are disposed so as to be oriented in the desired direction.

3. The infrared ray lamp according to claim 1, wherein the end faces of said heating elements, cross-sectioned in a direction orthogonal to the longitudinal direction thereof, is formed by a straight line and an arc line, and said flat faces of said heating elements are disposed so as to be oriented in the desired direction.

4. The infrared ray lamp according to claim 1, wherein said heating elements are solid carbonaceous heating elements inclining a carbonaceous substance and a resistance adjustment substance, and formed by firing.

5. A heating apparatus comprising:

two or more heating elements each having a long shape with at least one flat face and generating heat by virtue of application of a voltage, heating element holding means that disposes said heating elements in parallel so as to have a desired space therebetween and so that said flat faces of said heating elements are oriented in the desired direction, a glass tube in which said heating elements and said heating element holding means are sealed, lead wire portions electrically connected to said heating elements and derived from the sealed portion of said glass tube, and a reflector disposed so as to be opposed to said flat faces of said heating elements, wherein said heating elements are carbonaceous heating elements including a carbonaceous substance and formed by firing, and said heating element holding means comprises holding blocks which are made of a material having thermal conductivity, and which have slits for inserting and fixing said heating elements, and a spacer which is made of an insulation material, and which has cutouts for holding said holding blocks to have a desired interval and a desired angle by fitting said holding block into said cutouts.

6. The heating apparatus according to claim 5, wherein the cross-sectional shape of said reflector, cross-sectioned in the direction orthogonal to the longitudinal direction thereof, has a convex portion protruding at the central portion of the reflection face thereof in the direction opposed to said flat faces of said heating elements.

7. The heating apparatus according to claim 6, wherein said convex portion formed on said reflection face is configured so that the heat rays from said heating elements are not radiated to said heating elements.

8. The heating apparatus according to claim 5, wherein the cross-sectional shape of said reflector, cross-sectioned in the direction orthogonal to the longitudinal direction thereof, is a parabolic shape, and the substantially central point of heating in a heating element group consisting of said plural heating elements is disposed at the position of the focal point of said parabola.

9. The heating apparatus according to claim 5, wherein the cross-sectional shape of said reflector, cross-sectioned in the direction orthogonal to the longitudinal direction thereof, is a combination shape of plural parabolas, and the substantially central point of heating in each heating element is disposed at the position of the focal point of each parabola.

10. The heating apparatus according to claim 5, wherein the cross-sectional shape of said reflector, cross-sectioned in the direction orthogonal to the longitudinal direction thereof, has a convex face protruding in a direction being opposed to said flat faces of said heating elements at the central portion of the reflection face thereof, and is configured so that the heat rays from said heating elements are diffusely reflected by said convex face.

11. The heating apparatus according to claim 5, wherein the cross-sectional shape of said reflector, cross-sectioned in the direction orthogonal to the longitudinal direction thereof, has a concave-convex face positioned so as to be opposed to said flat faces of said heating elements at the central portion of said reflection face thereof, and so that the heat rays from said heating elements are diffusely reflected by said concave-convex face.

12. The heating apparatus according to claim 5, further comprises:

two or more external terminals respectively connected to said plural heating elements, two or more power source terminals connected to a power source, and a control circuit that selectively connects said external terminals to said power source terminals so that said heating elements are connected in series or parallel or connected independently.

13. The heating apparatus according to claim 5, further comprises:

two or more external terminals respectively connected to said plural heating elements, two or more power source terminals connected to a power source, and a control circuit that selectively connects said external terminals to said power source terminals so that said heating elements are connected in series or parallel or connected independently, wherein said control circuit is configured so that circuits for ON-OFF control, power application ratio control, phase control and zero-cross control are used independently or at least two of said circuits are used in combination.

14. The heating apparatus according to claim 5, wherein said heating elements are solid carbonaceous heating elements including a carbonaceous substance and a resistance adjustment substance, and formed by firing.

15. A heating apparatus comprising:

two or more heating elements each having a long shape with at least one flat face and generating heat by virtue of application of a voltage, heating element holding means that disposes said heating elements in parallel so as to have a desired space therebetween and so that said flat faces of said heating elements are oriented in the desired direction, a glass tube in which said heating elements and said heating element holding means are sealed, lead wire portions electrically connected to said heating elements and derived from the sealed portions of said glass tube, and a reflection film formed on said glass tube at a position opposed to said flat faces of said heating elements, wherein said heating elements are carbonaceous heating elements including a carbonaceous substance and formed by firing, and said heating element holding means comprises;

holding blocks which are made of a material having thermal conductivity, and which have slits for inserting and fixing said heating elements, and a spacer which is made of an insulation material, and which has cutouts for holding said holding blocks to have a desired interval and a desired angle by fitting said holding block into said cutouts.

16. The heating apparatus according to claim 15, further comprises:

two or more external terminals respectively connected to said plural heating elements, two or more power source terminals connected to a power source, and a control circuit that selectively connects said external terminals to said power source terminals so that said heating elements are connected in series or parallel or connected independently.

17. The heating apparatus according to claim 15, further comprises:

two or more external terminals respectively connected to said plural heating elements, two or more power source terminals connected to a power source, and a control circuit that selectively connects said external terminals to said power source terminals so that said heating elements are connected in series or parallel or connected independently, wherein said control circuit is configured so that circuits for ON-OFF control, power application ratio control, phase control and zero-cross control are used independently or at least two of said circuits are used in combination.

18. The heating apparatus according to claim 15, wherein said heating elements are solid carbonaceous heating elements including a carbonaceous substance and a resistance adjustment substance, and formed by firing.

19. A heating apparatus comprising:

two or more heating elements each having a long shape with at least one flat face and generating heat by virtue of application of a voltage, heating element holding means that disposes said heating elements in parallel so as to have a desired space therebetween and so that said flat faces of said heating elements are oriented in the desired direction, a glass tube in which said heating elements and said heating element holding means are sealed, lead wire portions electrically connected to said heating elements and derived from the sealed portions of said glass tube, and a cylinder having a cylindrical shape and disposed so at to cover said heating elements, wherein said heating elements are carbonaceous heating elements including a carbonaceous substance and formed by firing, and said heating element holding means comprises;

holding blocks which are made of a material having thermal conductivity, and which have slits for inserting and fixing said heating elements, and a spacer which is made of an insulation material, and which has cutouts for holding said holding blocks to have a desired interval and a desired angle by fitting said holding block into said cutouts.

20. The heating apparatus according to claim 19, further comprises:

two or more external terminals respectively connected to said plural heating elements, two or more power source terminals connected to a power source, and a control circuit that selectively connects said external terminals to said power source terminals so that said heating elements are connected in series or parallel or connected independently.

21. The heating apparatus according to claim 19, further comprises:

two or more external terminals respectively connected to said plural heating elements, two or more power source terminals connected to a power source, and a control circuit that selectively connects said external terminals to said power source terminals so that said heating elements are connected in series or parallel or connected independently, wherein said control circuit is configured so that circuits for ON-OFF control, power application ratio control, phase control and zero-cross control are used independently or at least two of said circuits are used in combination.

22. The heating apparatus according to claim 19, wherein said heating elements are solid carbonaceous heating elements including a carbonaceous substance and a resistance adjustment substance, and formed by firing.

23. The infrared ray lamp according to claim 1, wherein said hearing element holding means comprises:

holding blocks which are made of a material having electrical conductivity and thermal conductivity, and each of which includes a big diameter portion having slits for inserting and fixing said heating elements, and a small diameter portion formed to be connected to the big diameter portion through a step, and a spacer which is made of an insulation material, and which has cutouts for holding said holding blocks by fitting the small diameter portion of said holding block into said cutouts so that each flat face of said heating element has the predetermined angle with respect to the reference face.

24. The heating apparatus according to claim 5, wherein said heating element holding means comprises:

holding blocks which are made of a material having electrical conductivity and thermal conductivity, and each of which includes a big diameter portion having slits for inserting and fixing said heating elements, and a small diameter portion formed to be connected to the big diameter portion through a step, and a spacer which is made of an insulation material, and which has cutouts for holding said holding blocks by fitting the small diameter portion of said holding block into said cutouts so that each flat face of said heating element has the predetermined angle with respect to the reference face.

25. The heating apparatus according to claim 15, wherein said heating element holding means comprises:

holding blocks which are made of a material having electrical conductivity and thermal conductivity, and each of which includes a big diameter portion having slits for inserting and fixing said heating elements, and a small diameter portion formed to be connected to the big diameter portion through a step, and a spacer which is made of an insulation material, and which has cutouts for holding said holding blocks by fitting the small diameter portion of said holding block into said cutouts so that each flat face of said heating element has the predetermined angle with respect to the reference face.

26. The heating apparatus according to claim 19, wherein said heating element holding means comprises:

holding blocks which are made of a material having electrical conductivity and thermal conductivity, and each of which includes a big diameter portion having slits for inserting and fixing said heating elements, and a small diameter portion formed to be connected to the big diameter portion through a step, and a spacer which is made of an insulation material, and which has cutouts for holding said holding blocks by fitting the small diameter portion of said holding block into said cutouts so that each flat face of said heating element has the predetermined angle with respect to the reference face.

* * * * *

UNITED STATES PATENT AND TRADEMARK OFFICE

CERTIFICATE OF CORRECTION

PATENT NO. : 7,595,464 B2
APPLICATION NO. : 10/579618
DATED : September 29, 2009
INVENTOR(S) : Masanori Konishi It is certified that error appears in the above-identified patent and that said Letters Patent is hereby corrected as shown below:

On the title page, column 2, line 3 of the Abstract, "so at to be easily adaptable" should read -- so as to be easily adaptable --

In claim 19, column 29, line 21, "and disposed so at to" should read -- and disposed so as to --

In claim 23, column 30, line 4, "said hearing element" should read -- said heating element --

Signed and Sealed this

Twentieth Day of July, 2010

David J. Kappos

David J. Kappos
*Director of the United States Patent and Trademark Office*